US007971375B2

(12) United States Patent
Gabela et al.

(10) Patent No.: US 7,971,375 B2
(45) Date of Patent: Jul. 5, 2011

(54) TOOTH SYSTEM

(75) Inventors: Adnan Gabela, Kristinehamn (SE); Per Quarfordt, Storfors (SE); Cornelis Wempe, Spaarndam (NL); Klaas Wijma, Haarlem (NL)

(73) Assignees: Combi Wear Parts AB, Kristinehamn (SE); Vosta LMG B.V., Amsterdam (NL)

( * ) Notice: Subject to any disclaimer, the term of this patent is extended or adjusted under 35 U.S.C. 154(b) by 0 days.

(21) Appl. No.: 12/724,824

(22) Filed: Mar. 16, 2010

(65) Prior Publication Data

US 2010/0170120 A1 Jul. 8, 2010

Related U.S. Application Data

(63) Continuation of application No. 10/563,968, filed as application No. PCT/SE2004/001075 on Jul. 2, 2004, now Pat. No. 7,694,443.

(30) Foreign Application Priority Data

Jul. 11, 2003 (SE) ..... 0302061

(51) Int. Cl.
*E02F 9/28* (2006.01)

(52) U.S. Cl. ..... 37/455; 37/452; 37/450; 299/102; 299/85.2

(58) Field of Classification Search ..... None
See application file for complete search history.

(56) References Cited

U.S. PATENT DOCUMENTS 2,148,309 A * 2/1939 Stephens ..... 299/103
2,167,425 A 7/1939 Page
2,385,395 A 9/1945 Baer
2,613,069 A * 10/1952 Bruestle ..... 299/102
2,791,414 A 5/1957 Kreleler et al.
3,349,508 A 10/1967 Petersen
3,808,716 A 5/1974 Verbeek
4,050,172 A 9/1977 Petersen
(Continued)

FOREIGN PATENT DOCUMENTS

DE 2153964 9/1972
(Continued)

OTHER PUBLICATIONS

International Search Report No. PCT/SE2004/001075, dated Oct. 4, 2004, 3 pages.

*Primary Examiner* — Thomas A Beach

(74) *Attorney, Agent, or Firm* — Connolly Bove Lodge & Hutz LLP

(57) ABSTRACT

A tooth system for a tool for earth moving machinery that includes a holder located on the tool and a front tooth portion that is detachably arranged on and in relation to the holder, which tooth portion is in the form of a replaceable wear/replacement part with a rear leg and the holder embodies a cavity designed to receive the leg of the tooth portion. This achieves a unified joint for assimilation of occurring loads via a predetermined connection geometry embodying special, opposite, mutually interacting contact surfaces and clearance surfaces arranged along the tooth portion and holder. The joint includes a multi-armed, preferably cruciform, cross section comprising at least four projection arms and at least four grooves each that interact with each projecting arm. Each projection arms includes a vertically arranged, upper arm, lower heel and two, essentially horizontally and laterally arranged, wing portions, with a tensioning device.

24 Claims, 15 Drawing Sheets

U.S. PATENT DOCUMENTS

| | | | | | |
|---|---|---|---|---|---|
| 4,240,669 | A | | 12/1980 | Rollins | |
| 4,261,620 | A | * | 4/1981 | Troxler | 299/113 |
| 4,275,929 | A | * | 6/1981 | Krekeler | 299/102 |
| 4,320,925 | A | * | 3/1982 | Bowes, Jr. | 299/101 |
| 4,343,516 | A | * | 8/1982 | Aden | 299/106 |
| 4,542,943 | A | * | 9/1985 | Montgomery, Jr. | 299/102 |
| 4,609,227 | A | * | 9/1986 | Wild et al. | 299/103 |
| 4,621,871 | A | | 11/1986 | Salani | |
| 4,642,920 | A | | 2/1987 | Lehnhoff | |
| 4,693,518 | A | | 9/1987 | Sulosky et al. | |
| 4,913,125 | A | | 4/1990 | Bunting et al. | |
| 4,915,455 | A | | 4/1990 | O'Neill et al. | |
| 5,011,229 | A | * | 4/1991 | O'Neill et al. | 299/102 |
| 5,778,570 | A | | 7/1998 | Eichelberger | |
| 6,854,810 | B2 | * | 2/2005 | Montgomery, Jr. | 299/106 |
| 2007/0245602 | A1 | | 10/2007 | Gabela et al. | |

FOREIGN PATENT DOCUMENTS

| | | |
|---|---|---|
| GB | 1297827 | 11/1972 |

* cited by examiner

TOOTH SYSTEM

CROSS REFERENCE TO RELATED APPLICATIONS

This application is a continuation of co-pending application Ser. No. 10/563,698, filed on Jun. 28, 2007, and for which priority is claimed under 35 U.S.C. §120; which is a national phase filing under 35 U.S.C. §371 of PCT/SE2004/001075 filed Jul. 2, 2004; and which claims priority to Patent Application No. 0302061-7, filed in Sweden on Jul. 11, 2003. The entire contents of each of the above-applications are incorporated herein by reference.

TECHNICAL AREA

The present invention relates to a tooth system for a tool for earth moving machinery, which tooth system is of the type comprising a holder located on the tool and a front tooth portion that is detachably arranged on and in relation to the holder, which tooth portion is in the form of an exchangeable wear and/or replacement part intended for the actual earth moving, which tooth portion comprises a rear leg and the holder comprises a cavity designed to receive the leg in interaction with the tooth portion and thereby achieve a unified joint for assimilation of occurrings loads, $F_s$, $F_c$, $F_p$, via a pre-determined connection geometry comprising special, opposite, mutually interacting contact surfaces and, at least initially, clearance surfaces that are arranged along the tooth portion and holder.

PROBLEM PRESENTATION AND BACKGROUND TO THE INVENTION

Today there are a number of different commercial tooth systems for replaceable wear and/or replacement parts for tools to an earth moving machine for loosening and breaking more or less hardened earth and rock mass out of a work surface, after which the masses are appropriately removed. An example of such tools and exchangeable wear and/or replacement part is, here, especially comprised by a dredging tool's rotating bore bit, also called a cutter head, with its replaceable wear teeth. Clearly, these tooth systems can also be used for other types of earth moving machinery, such as the bucket to a digger, etc.

Regarding especially cutter heads, said wear teeth, see FIG. 2, are arranged at a given distance from each other, generally helical, elongated along blades protruding from a central body attached to a central, rotating hub. The blades suitably extend in a helical line from the hub at the forward end of the body and rearward in the tool's feed direction to the rear end of the rotating body comprising a back ring, holding the blades together, where also a suction device is arranged for removal of the loosened earthen mass through the interspace between the blades.

Such tooth systems usually comprise two main connection parts in the form of a "female" and a "male" part that together form a full, assembled "tooth" in a series of adjacently arranged teeth along, for example, the bore bit's blades or the bucket's cutting edge. Such a "tooth", thus, comprises a forward wear-part in the form of a replaceable tooth portion with a (cutting) point and comprising a rear leg for mounting in a specially-designed groove at a rear, stationary holder, which suitably is firmly fixed to, for example, the bore bit. To achieve a dynamic yet reliable attachment of the replaceable tooth point to the holder, the connection parts also comprise a connection system common to the parts and with a detachable locking mechanism. Every such connection system has a distinctively characteristic geometry, comprising the surfaces and the form of the legs and grooves named above, in order to thereby attempt to have the wear-part of each "tooth" held effectively and safely in place in a function-sufficient manner that embodies minimal wear to the wear-part until, due to inevitable wear, the wear-part must be replaced.

Such commercial tooth systems are designed to absorb loads (F) from the use of the tool through specially designed and mutually interactive contact zones, which are arranged along the joint between the connection parts defined by the leg and groove. Each contact zone comprises at least two mutually opposing and interacting contact surfaces arranged one on each connection part and arranged at a given angle to the line of axial symmetry Y of said joint. When these contact surfaces are placed mainly perpendicular to said axial line of symmetry Y, i.e. essentially in the cross vertical plane (XZ), the further insertion of the tooth part on the holder part is stopped completely, why these surfaces are also hereafter referred to as stop surfaces. Another way is to arrange the contact surfaces in a more acute angle to the connection parts' joining direction along the joint, where the load is absorbed by the friction forces generated by the wedging effect of the friction surfaces.

However, it is to be understood that when the tool is used there are not only active loads that are parallel to the connection geometry along with a longitudinal plane of symmetry Y, but also loads that deviate from the Y direction. Essentially, every active load (F), thus, comprises, see FIG. 18, in part a shearing force component, $F_c$ that acts essentially from the front parallel to the work surface and axially placed in relation to the said joint, in part a normal force component $F_s$ that acts essentially from above, perpendicular to the work surface and in part a transverse force component $F_p$ that acts from the side, essentially parallel to the work surface and more perpendicular in relation to said tooth part's protrusion beyond the connection parts' common joint.

The position terms used below such as rear, forward, lower, upper, vertical, transverse or horizontal surfaces, etc., can consequently be inferred from the definitions, as stated above, of said forces and the mutual relationship of the connection parts, as well as their relations and positions relative to the work surface.

The new concept for a tooth system, as stated in the present patent application, comprises a number of characteristics, which characteristics alone or in combination are unique in comparison with the presently available tooth systems and which characteristics afford advantageous solutions to a number of problems that can arise with known tooth systems.

A number of these problems are summarized below.

Among conventional tooth systems it is a fact that despite the tooth system being relatively strong, the contact area along the tooth system's joint, between the tooth holder and tooth point, is too limited. This especially applies at the front end and at the front side (A) of the joint where the loads arising from the tool currently being used are the greatest. This causes far too great surface loads and, thus, also causes a large degree of undesirable wear, which essentially reduces the effective wear life cycle of the tooth system holder. This constitutes the real "bottle neck" of the tooth systems, because the holder is designed to be reused as long as possible and, hence, usually is fixed to the tool in a stationary way, e.g. by a weld, while the tooth is, itself, designed to be worn, and which tooth therefore is fitted in a removable manner to afford replacement as easily and rapidly as possible. The "front side of the joint", here, actually means the interactive stop surfaces, essentially in the cross vertical plane (XZ), at an impact zone between the holder and the tooth at the beginning of the joint between them, that is, the holder's side that essentially faces the surface worked upon by the tool. Replacement of the holder is, thus, expensive not only due to the intensive time lost but also due to the material parts that have to be discarded.

A consequent problem is that the conventional tooth systems that have all too wide a degree of play between the tooth and holder develop problems with "hammering", that is, said parts are powerfully impacted against one another during the use of the tool. This hammering causes considerable increase in wear. Those tooth systems that instead have all too narrow a degree of play, that is have a too small gap between the tooth and holder, develop the problem of the tooth becoming difficult to remove from the holder.

Tooth systems designed for earth moving encounter their greatest, and thus, as regards the tooth system design, most often the gravest loads when breaking hard rock. This is due to the very large normal loads $F_s$ that impact essentially perpendicularly to the rock, as such occurs in the course of breaking rock. The known tooth systems, by prior art, thus usually obtain disadvantageous wear damage along the joint between component connection parts of the tooth system, as these lack the required capacity to withstand such $F_s$ loads.

Difficulty in cleaning away dirt and removed earth residues that invariably accumulate in the passages along the holder and tooth, that is, between the joint's contact and clearance surface(s) and also that the holder is difficult to repair on the side essentially facing away from the working surface, that is, the back side are commonly occurring problems with known "leg-type" tooth systems, that is, those tooth systems that have a tooth with a leg that is inserted into a groove in the holder to achieve a joint between the tooth and the holder.

After a period of use the impacting surface forces along the known tooth system's joints shall cause considerable wear and a degree of plastic deformation of the effective parts, which requires expensive and often complicated maintenance. Existing leg-type tooth systems also can not be given increased strength when changing the connection geometry of the joint.

Conventional tooth systems comprise a locking system that is difficult to improve upon in the confined space available between the tooth and holder at the location of the locking device being used and these tooth system do not allow separate types of locking systems and/or modifications to the locking system itself without the tooth's and/or holder's joint first being adapted to the given locking system and/or its modifications.

Further, conventional locking systems, that is, those comprising some form of rigid locking device, e.g. a steel pin, and a locking aperture designed for the locking device, must remove the locking device with a heavier hammer or sledge, which requires considerable work and can cause damage to the locking system and/or the teeth. Thus, it is desirable for the given locking device to be removable and attachable in a simpler and more effective way without incurring any essential risks for such as the said damages arising.

As the locking system wear increases conventional locking systems lose their ability to maintain a retentative force that holds the connection parts together, that is, their pretensioning capacity, which causes the said hammering to worsen significantly and the tooth to finally be destroyed and/or fall out of the tool.

Known tooth systems normally have holder contact surfaces, along the sides of the joint, with high degree of strength, regarding the winch forces ($F_s$), acting essentially axially along the tooth point that is, the normal forces impacting more or less vertically against the working surface; see FIG. 17, and that are usually absorbed by stop surfaces arranged somewhere along the impact zone between the holder and the tooth, but that are also transferred as friction forces axially along the tooth's axial symmetry axis Y to the contact surfaces along the essentially longitudinal sides along the tooth system's joint. However, the same does not apply to corresponding transverse forces $F_p$ that essentially impact parallel with the breaking surface and, thus, more perpendicular to the tooth's axial symmetry axis Y. These transverse forces ($F_p$) and those moment forces resulting from them are also essentially absorbed by the contact surfaces along the holder's joint, but said contact surfaces usually have significantly lower strength against such transverse ($F_p$) and resultant forces.

PRIOR ART

An example of a cutter head can be had from that described in the American Patent document U.S. Pat. No. 3,808,716.

An example of the leg-type tooth system can be had from the American Patent document U.S. Pat. No. 4,642,920 and the German document DE-2 153 964, which describe two tooth systems, each with a locking system comprising a rear, pretensioned locking mechanism.

The tooth systems according to U.S. Pat. No. 4,642,920 and DE-2 153 964 have several unsolved problems and disadvantages of which the following can be named:

- a disadvantageous leverage ratio for transverse ($F_p$) and normal ($F_s$) forces, which is substantially greater than one, why the tooth can bend or break off during hard work;
- that the tooth systems have difficulty absorbing the loads and torsional forces impacting at the front side of the holder, that is, at the forward joint surfaces in the cross-vertical plane (XZ), due to insufficient contact surfaces; for example, the torsional forces along said Y axis cause the corners of the substantially quadratic leg, as stipulated in DE-2 153 964 and U.S. Pat. No. 4,642,920, are quickly worn down after which the tooth's function is severely degraded since the tooth's position become rotated;
- and, further, the rear minimal aperture for the tensioning device is normally blocked by the same, which is why dirt fastens between tooth and holder, which dirt can only be removed with difficulty after the tooth system has been disassembled.

Also document U.S. Pat. No. 3,349,508 shows a leg-type tooth system and is intended for an excavation bucket, but this system also comprises a dove-tailed groove for assembling the two connection parts to one another, while wholly lacking such a rear, pretension-lock mechanism with tensioning device. Here instead a complicated solution in the form of an elastic strap was used, that could be easily damaged or fall off when replacing a tooth when the midsection of the strap is arranged outside the holder. Further the locking function is reduced or ceases altogether as the elastic strap is worn, ages; dries out and cracks or otherwise sustains damage. It is also noted that if one or both of the ends of the straps would get caught in an inclined position in side the holder's cavity then the tooth leg can not be correctly inserted. The strap is also subjected to all the load dynamics since it is always caught between the contact surfaces of the holder and the tooth leg when in operation. The tooth system described by U.S. Pat. No. 3,349,508 has, in practice, only one participating contact zone for absorption, metal against metal, of the torsional forces about the Y axis since the vertical back is, preferably, without contact surfaces, e.g. it is non-contacting, and one of the two horizontal "arms" in the cross section presses against the elastic strap. In practice, essentially all wear will therefore occur at the contact zone of the first arm, where metal meets metal.

INVENTION'S OBJECTIVE AND DISTINGUISHING CHARACTERISTICS

An important object of the present invention is to achieve a new and improved tooth system for the tool for an earth removal machine, which tooth system essentially reduces or wholly eliminates the wear between the different connection parts caused by hammering and/or caused by too large surface loads on the tooth system's joint between the holder and tooth point.

Another object of the present invention is to achieve a new and improved tooth system, which tooth system essentially reduces or wholly eliminates the problem with disadvantageously large wear damage along the joint between the tooth system's component connection parts due to the very large loads arising during, e.g., the breaking of hard rock mass.

Yet another object of the present invention is to achieve a leg-type tooth system, which is easy to clean of dirt and earth removal residue that accumulate between the holder and the tooth portion and along the joint's contact and clearing surface(s), and further with a holder that can be easily repaired at its back side.

The new and improved tooth system is also designed to essentially reduce and simplify the earlier, often complicated maintenance caused by the wear and the plastic deformation along the known tooth system's inner joint due to the impacting surface forces between the interactive parts. The new and improved tooth system also affords a possibility to increase the strength for the same due to a change in the connection geometry.

Further objects of the present invention are: to achieve anew and improved tooth system, which tooth system comprises an improved locking system that allows different types of locking systems and/or modifications to the locking system to be used without essentially adapting the tooth portion's and/or holder's connection system to the given locking system and/or modifications thereof; that given locking devices can be assembled and removed in a simpler more effective manner and without any essential safety hazards arising therefrom; and that the locking system retains the capacity to maintain a fixity and the cohesive force of the connection parts, as the locking system wear increases and the above said hammering essentially is reduced or wholly eliminated.

Further, there is an object of the present invention to design a tooth system whose joint affords great strength with regard to the transverse forces ($F_p$), which essentially impacts parallel to the working surface but perpendicular to the axial symmetry axis of the tooth portion.

The objectives so named, as well as other, here, non-enumerated purposes are achieved within the framework indicated in the present independent patent claims. Embodiments of the invention are indicated in the dependent patent claims.

Thus, in accordance with the present invention one has achieved an improved tooth system distinguished by the tooth leg and holder cavity, along at least a front part of said joint, to have a multi-armed, preferably cruciform, cross section comprising at least four projection arms and at least four grooves each that interact with each projecting arm, respectively, which projection arms comprise an, essentially vertically arranged, upper arm, a, essentially vertically arranged, lower heel and two, essentially horizontally and laterally arranged, wing portions, wherein a tensioning device is arranged at the rear part of the cavity in order to achieve adjustable pretensioning that tightens the tooth portion in relation to the holder, essentially axially along the axial symmetry axis Y of the cavity.

The joint and pretensioning, thus, ensure that the tooth portion shall always be positioned in a predetermined position in relation to the holder and, thus, also in relation to the given tool and work surface during the entire life cycle of the tooth system.

ADVANTAGES AND EFFECTS OF THE INVENTION

Below is summarized a number of characteristics of the tooth system in accordance with the present invention and embodiments thereof that define advantageous solutions to the problems of tooth systems known by prior art, as summarized above.

The multi-armed, preferably x-shaped, joint unifies a high degree of strength with a large contact area. On the front side of the tooth system joint, where the loads are greatest, the contact area is also advantageously large, while the contact area can be advantageously less at the rear end of the joint, that is, the end of the leg, where the loads are less.

The new tooth system combines advantages from the tooth systems known by prior art as described above. The part of the tooth system connection parts forming the female part, that is, the holder, that receives the other part inside itself displays a, preferably somewhat internally convergent, x-shaped front side and front part, that is, the joint surfaces in the cross-vertical plane (XZ) between the interacting sides of the tooth portion and holder, facing one another, including the corresponding surfaces along the front part of the dovetail groove and the front part of the tooth portion's leg, being multi-armed with at least four arms, preferably cruciform or x-shaped, with a notch or dovetail groove that is internally convergent towards its back end.

This, at least cruciform and preferably somewhat convergent dovetail groove affords a play-free fixity and prevents faulty alignment since the tooth portion, that is, the male part, upon use, is pressed into the female part with increased contact along the contact surfaces along the joint between the two parts. The cruciform design, thus, ensure that the tooth portion shall always be aligned in a predetermined position in relation to the holder and, thus, also in relation to the given tool and work surface during the entire life cycle of the tooth system. This is an especially important characteristic used with advantage by the tooth system of a dredger cutter since the dredger cutter is one of the tools which has the highest requirements for how the teeth are arranged. Cruciform or star-shaped etc. projection arms also afford a considerable improvement of the durability, rigidity and strength of the tooth system.

Thus, at the point where the loads normally are the greatest said problems with hammering does not arise, which is why the play induced wear will not arise. At the middle part of the dovetail groove, a lesser degree of play is, at least initially, arranged on the one hand, between the vertical sides of the leg and the accordant vertical sides of the dovetail groove, at the bottom of the groove, that is, at the lower corners of the cross section (T2) and, on the other hand, the vertical sides of the spine peak and the dovetail groove's accordant vertical sides at its neck and also between the lower side of the leg and the dovetail groove's accordant bottom; but at the said play, the loads are also significally lower.

The multi-arm form at the front of the holder also affords the great advantage of having, after only inserting the male part a minimal distance into the female part, all relevant loads, including all torques, absorbed by a very large contact area compared with what is known by prior art, which is why the surface load becomes very small and wear is consequently minimal. The tooth portion can also be very easily removed from the dovetail groove because the interacting parts do not grind against one another since the surface load and deformation are so low. With equivalent loads in combination with a convergent joint, a plastic deformation will presently occur between the groove and the leg that, more or less, "molds" together the parts by means of the plastic deformation.

To further reduce the effect of the torque loads, the present tooth system design uses the lever principle in an optimal manner. The two torque arms, on either side of the given fulcrum point, around which torsion occurs in the joint between the connection parts, become "lifting arm" (b) and "reaction arm" (r). In order to absorb the greatest loads the tooth system must withstand, that is, here most often the normal loads $F_s$ that arise when breaking hard rock mass, the leverage ratio between the free, projecting length of the tooth portion and the length of those parts of the tooth portion and holder that interact from said fulcrum point inwardly along the joint for the absorption of the impacting loads, that is, from the leg and dovetail groove, less than one, that is, (b)/(r)<1. This ratio is closer to two, or (b)/(r)=~2 for conventional tooth systems, which is why the loads at the joint also becomes essentially twice as large with a considerably increased hazard for damage.

The new design has a joint between the holder and the tooth portion in the form of a rearwardly and upwardly open notch along the top side, preferably an open dovetail groove, which makes possible simple cleaning of the joint. It is actually sufficient to install a new tooth portion in order for cleaning to be done, because the installation of the tooth portion itself causes possible accumulations of dirt to be pushed in front of the tooth part and out through the notch's outer, rear end at the rear of the holder.

A further advantage with the present tooth system is that it allows, to a greater extent, the use of many different types of locking systems and/or modifications to the locking system itself, without the common joint of the tooth portion and/or holder having to be significantly adapted to the given locking system and/or modifications thereto, e.g., due to a cross-going aperture for the locking device, pervading both connection parts, comprising two consecutively coaxial apertures. At a plastic deformation, where the connection parts are pressed into one another, these apertures are displaced in relation to one another so that the locking mechanism can be cut off, whereupon the tooth falls out. A new tooth portion can no longer be installed because the new locking device aperture in the new tooth portion no longer fits the displaced locking device aperture of the worn holder. With the present locking system, the locking device is installed, adjusted and removed axially at the rear end of the tooth system and this is done without possible deformations of the joint connection geometry complicating the work to be done.

In the present tooth system, the locking device of the locking system can also be removed and installed by means of some standard tools, suitably an air or electrically powered wrench, without damage hazards arising therefrom.

According to a preferred embodiment of the present tooth system's possible locking systems that comprise an elastic body whereby the locking systems obtain the same pretensioning capacity each time a new tooth portion is installed despite the holder being worn.

The connection geometry between the tooth portion and holder of the present tooth system is equipped with an protruding part, below referred to as heel or torque heel, with a definite external geometry and a corresponding depression to interact with the heel, in order to absorb the laterally impacting transverse forces ($F_p$), see FIG. 18, that essentially impact parallel to the working surface but perpendicular to the axial symmetry axis of the tooth point. Preferably the heel is arranged at the tooth portions underside and the depression at the bottom of the notch/dovetail groove. Said heel and depression are preferably arranged lengthwise at a position in the notch/dovetail groove that corresponds, after installation of the leg, to the optimal position for the tooth system's function with regard to the loads and torques that can conceivably arise during the use of the tool. This means that when laterally impacting transverse forces ($F_p$) arise, primarily the heel and depression will absorb the transverse forces ($F_p$) directly through the existing contact surfaces along one lengthwise side of the heel (either the right or left lengthwise side depending on the given transverse force's direction of impact) while, through the torsion acting on the heel, the rear opposing contact surface along the dovetail groove's lengthwise side absorbs a significantly lower force. The torques resulting from transverse forces ($F_p$), around the joint's Y axis, along the notch/dovetail groove are mainly absorbed by the horizontal contact surfaces along the tooth portion's wings that are inserted in the aforementioned, e.g. cruciform, front side, that is, the essentially horizontal joint surfaces between the interacting, mutually opposed sides of the tooth portion and holder in said multi-armed part.

LIST OF FIGURES

The invention shall be described more closely in the following with reference to the attached Figure(s), where:

Figure 1:
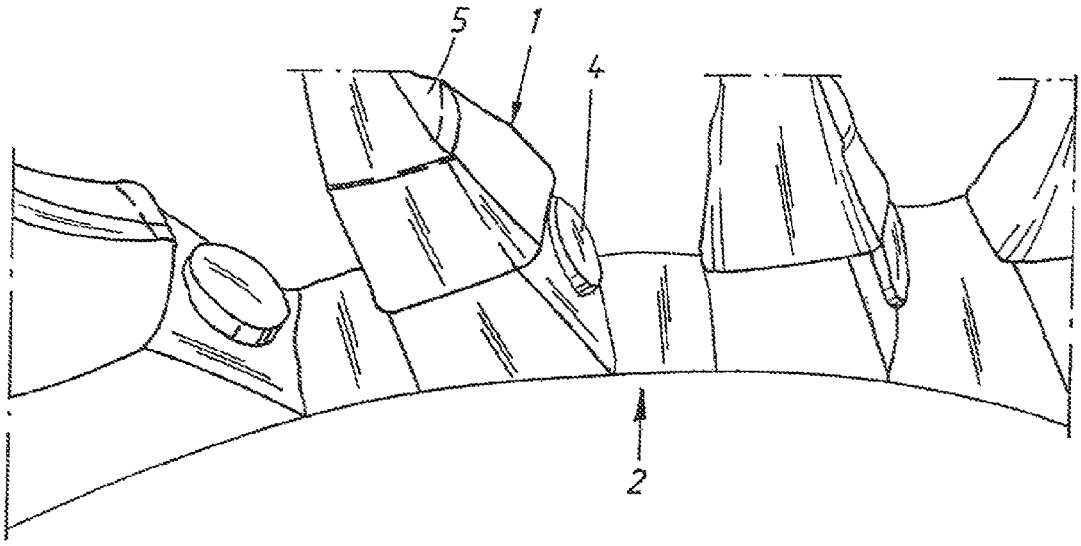
FIG. 1 is a schematic perspective of parts of the tooth system in accordance with the present invention comprising frontal, replaceable tooth portions each of which are removably attached to a rear holder that is securely arranged along a protruding blade on a rotating body of a dredger cutter.
Figure 2:
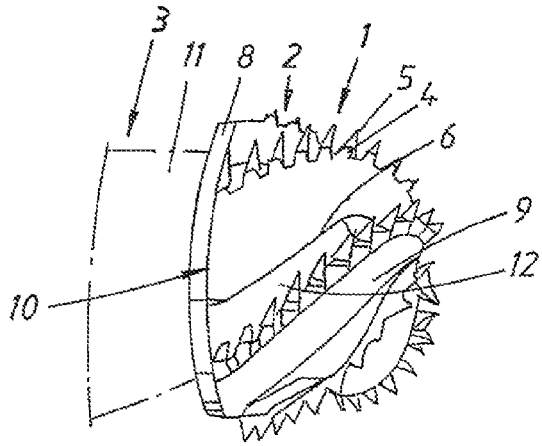
FIG. 2 is a schematic side view of the dredger cutter in accordance with FIG. 1, which side view shows more closely the helical blades and the rear suction device for the loosened earthen masses.
Figure 3:
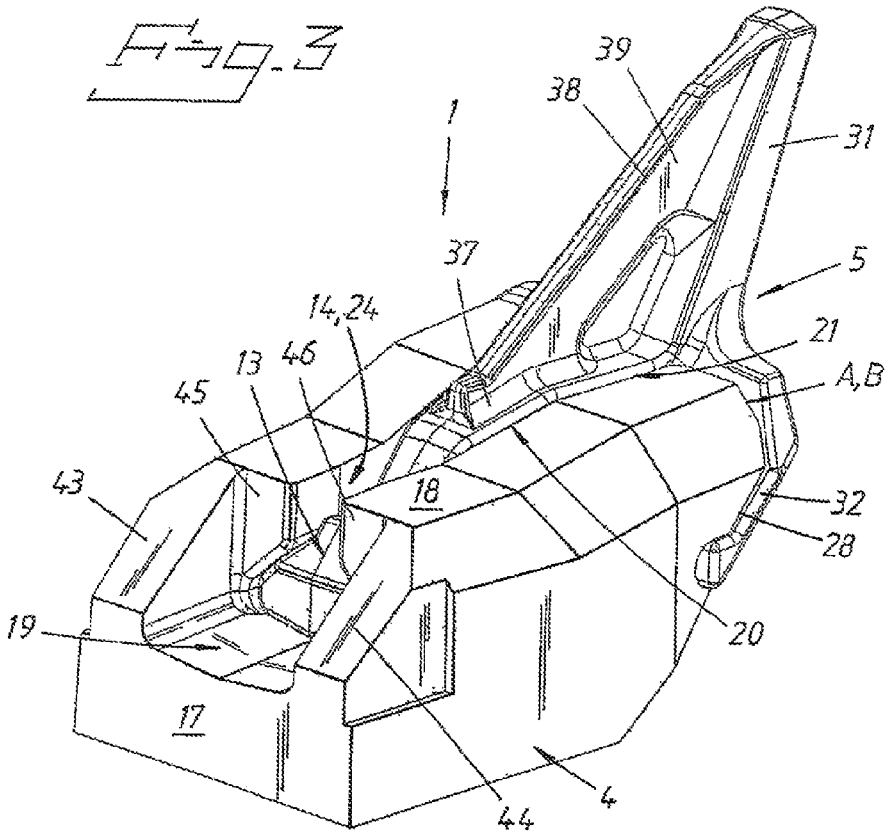
Figure 4:
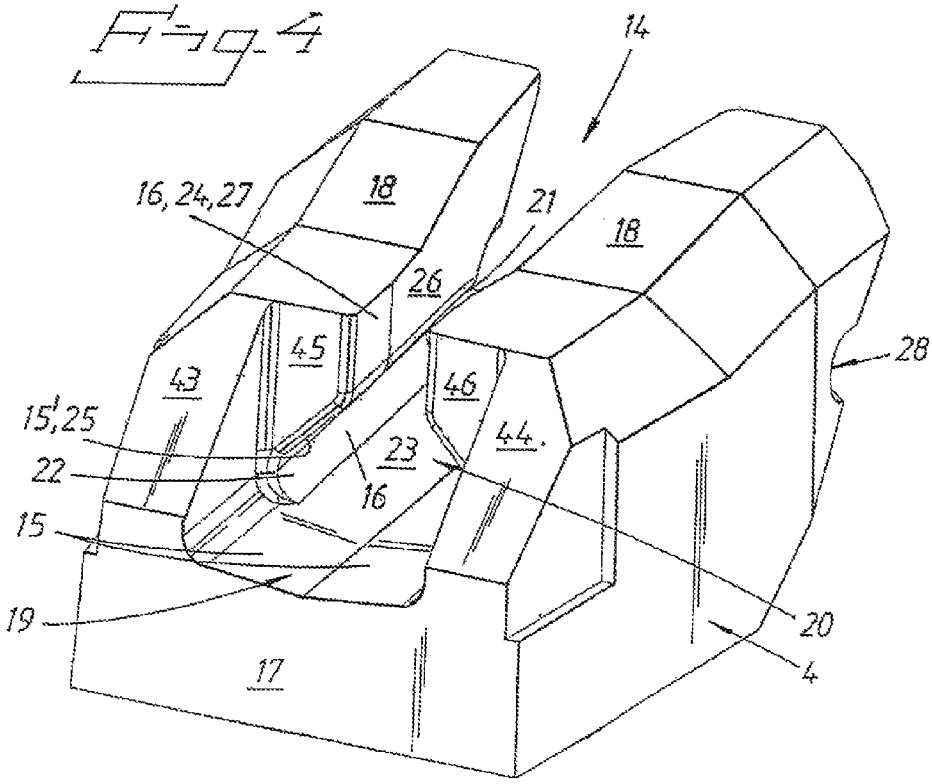
Figure 5:
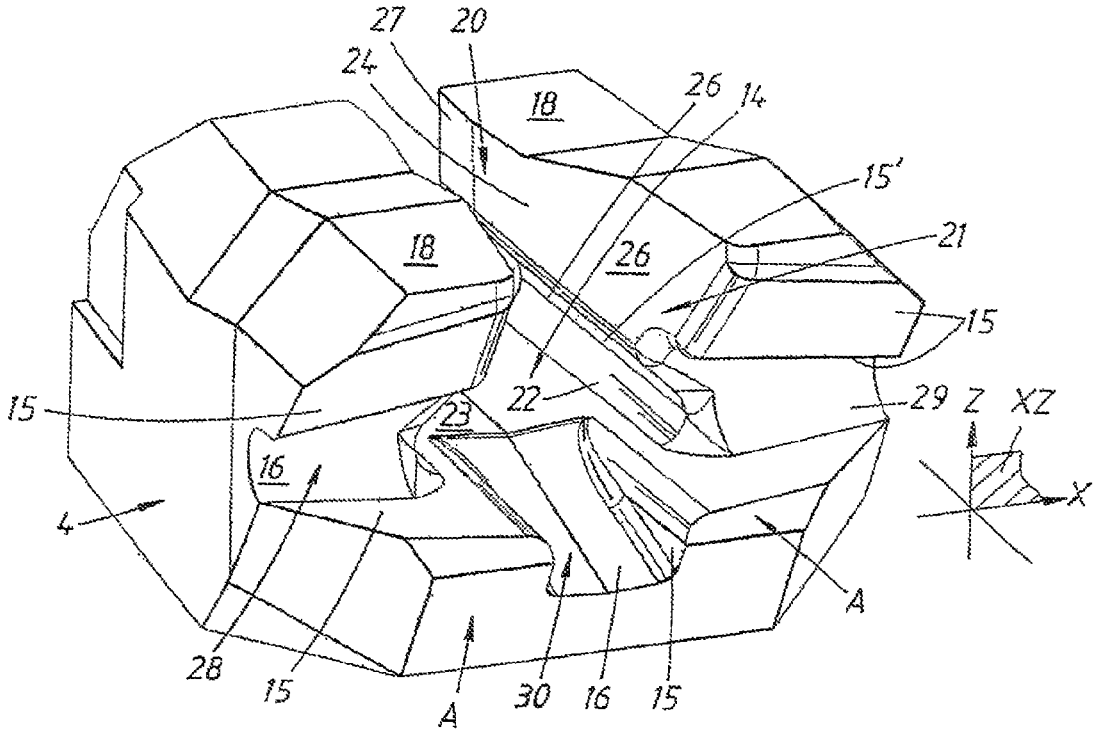
Figure 6:
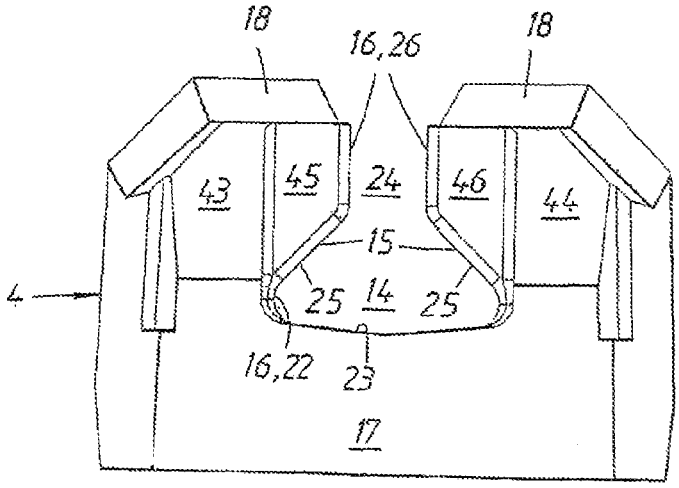
Figure 7:
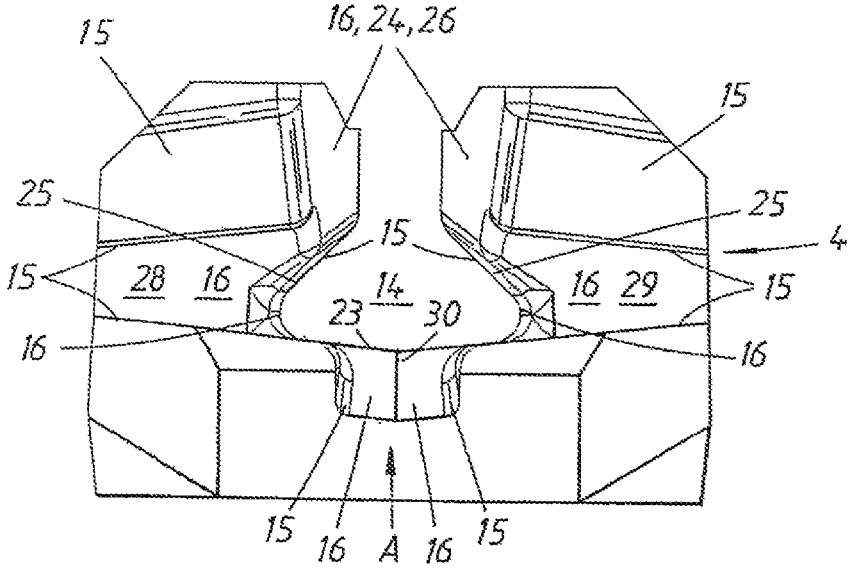
Figure 8:
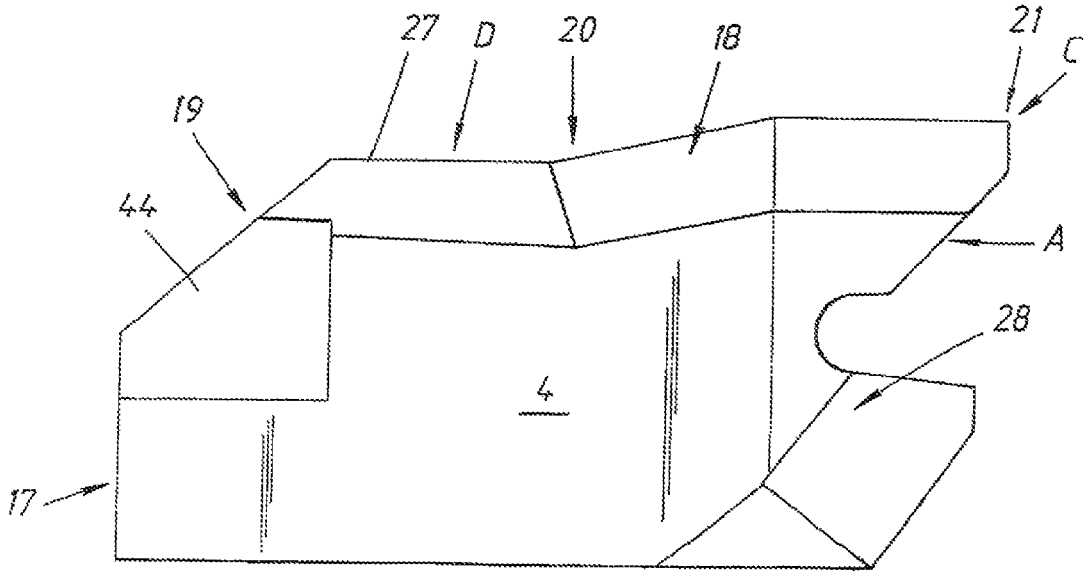
Figure 9:
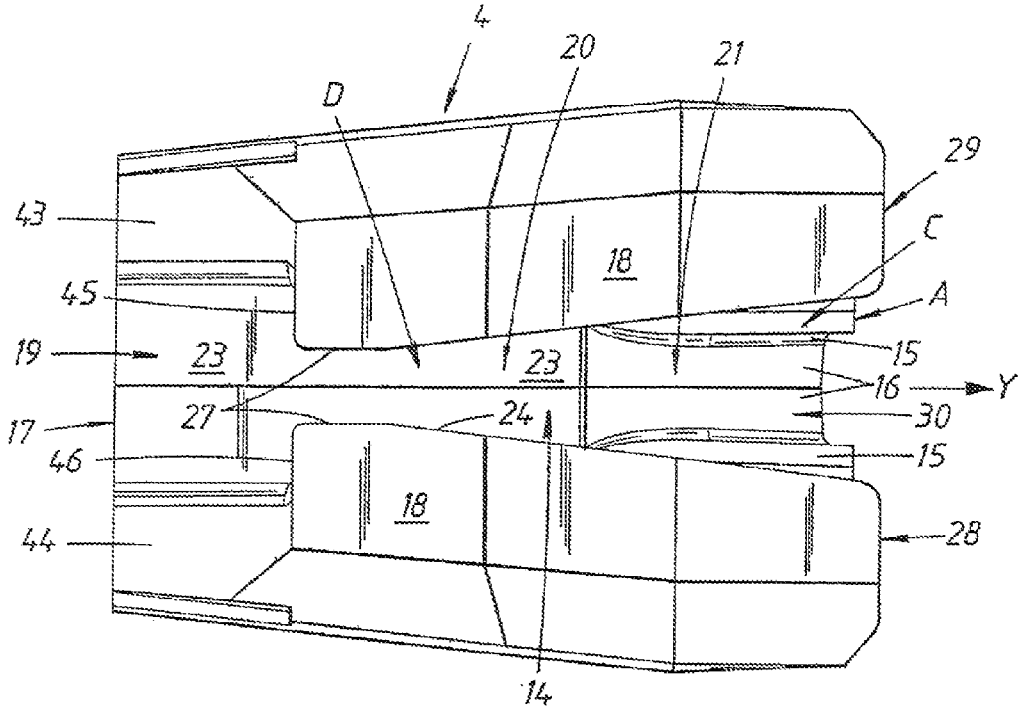
Figure 10:
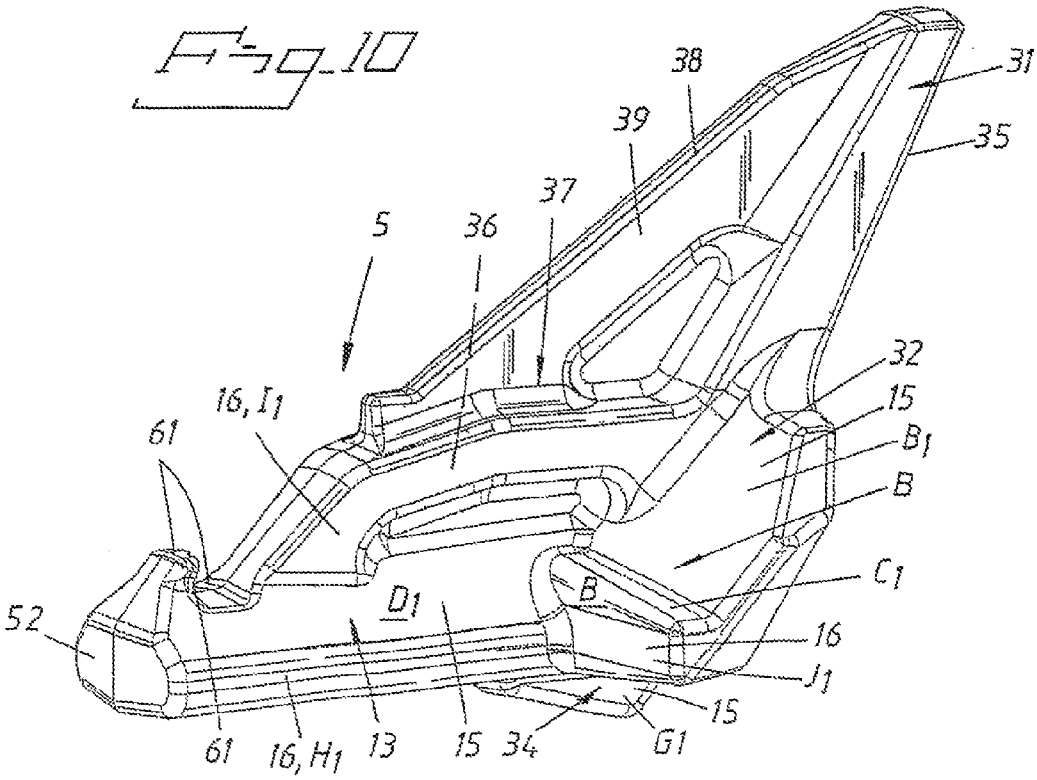
Figure 11:
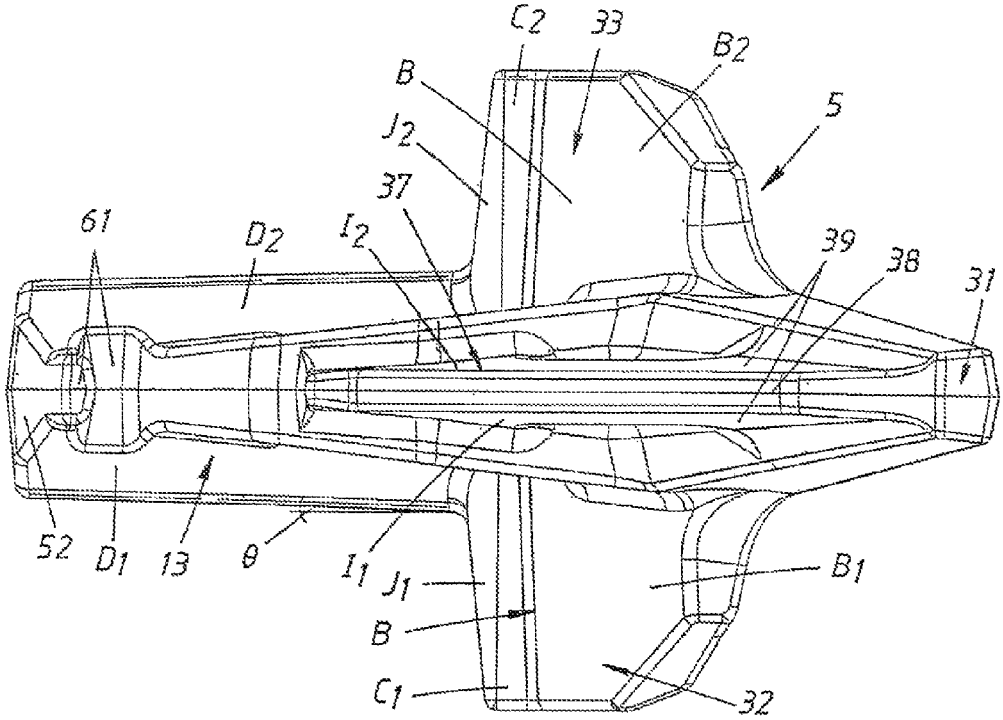
Figure 12:
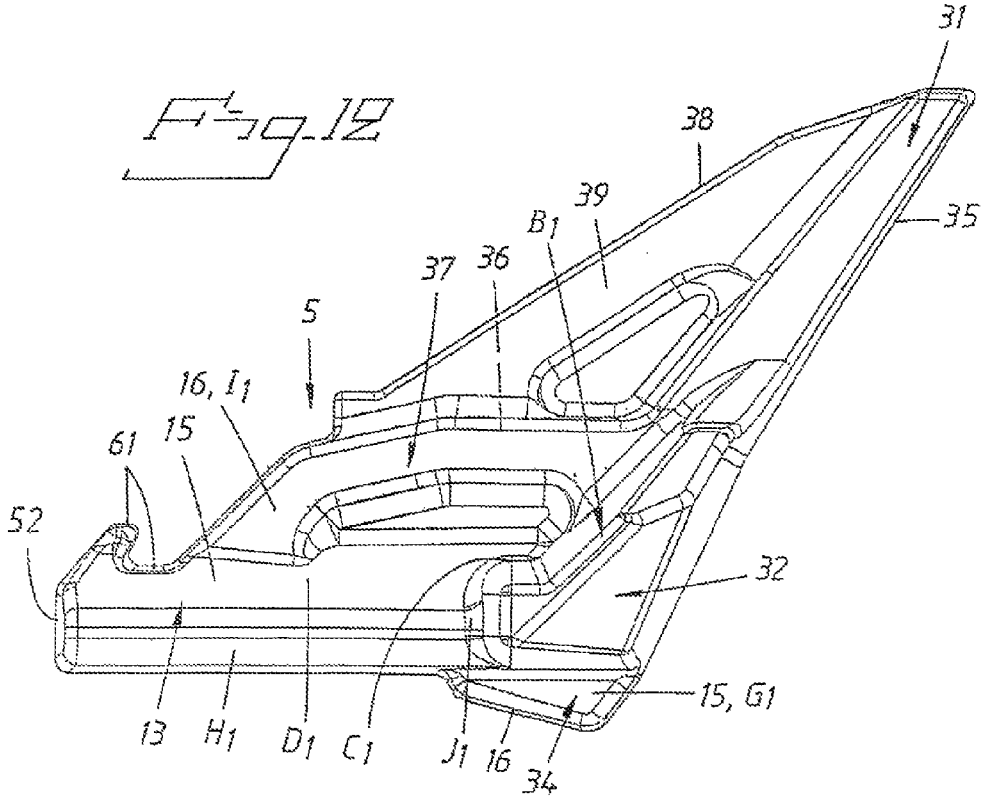
Figure 14:
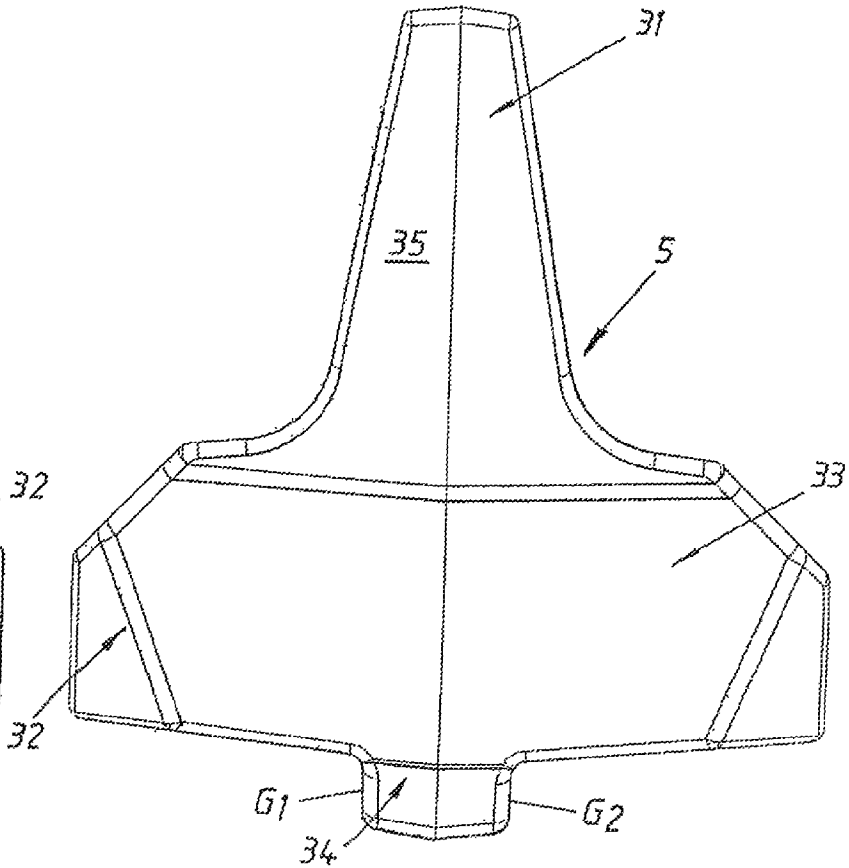
Figure 12:
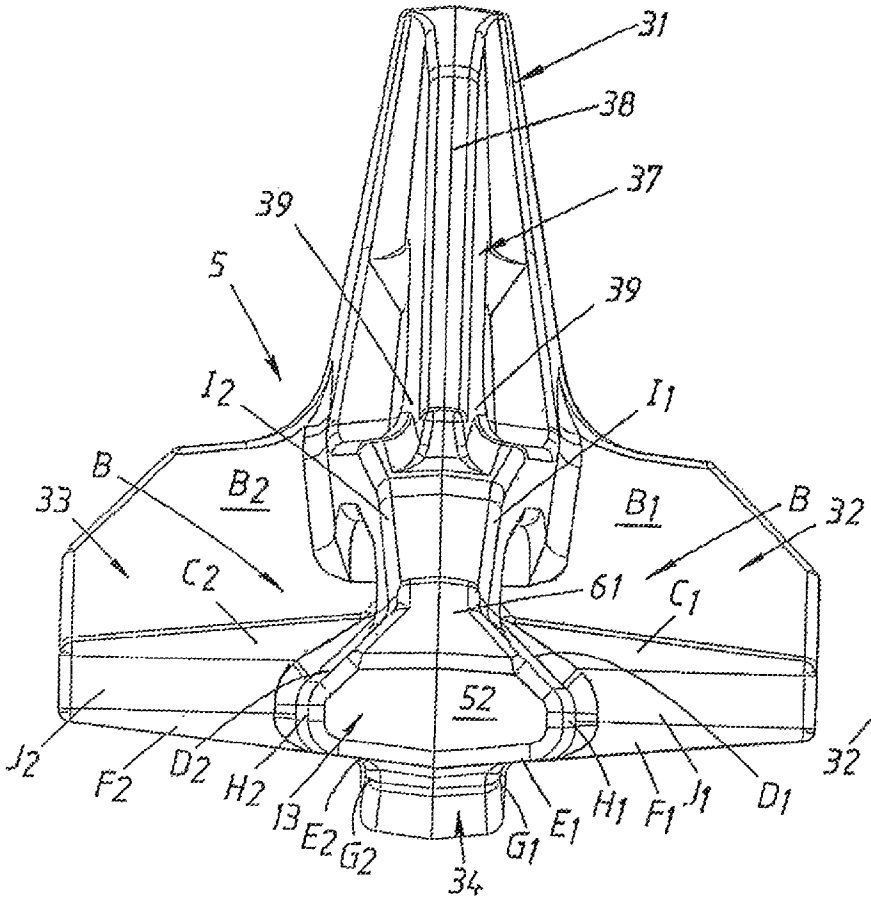
Figure 15:
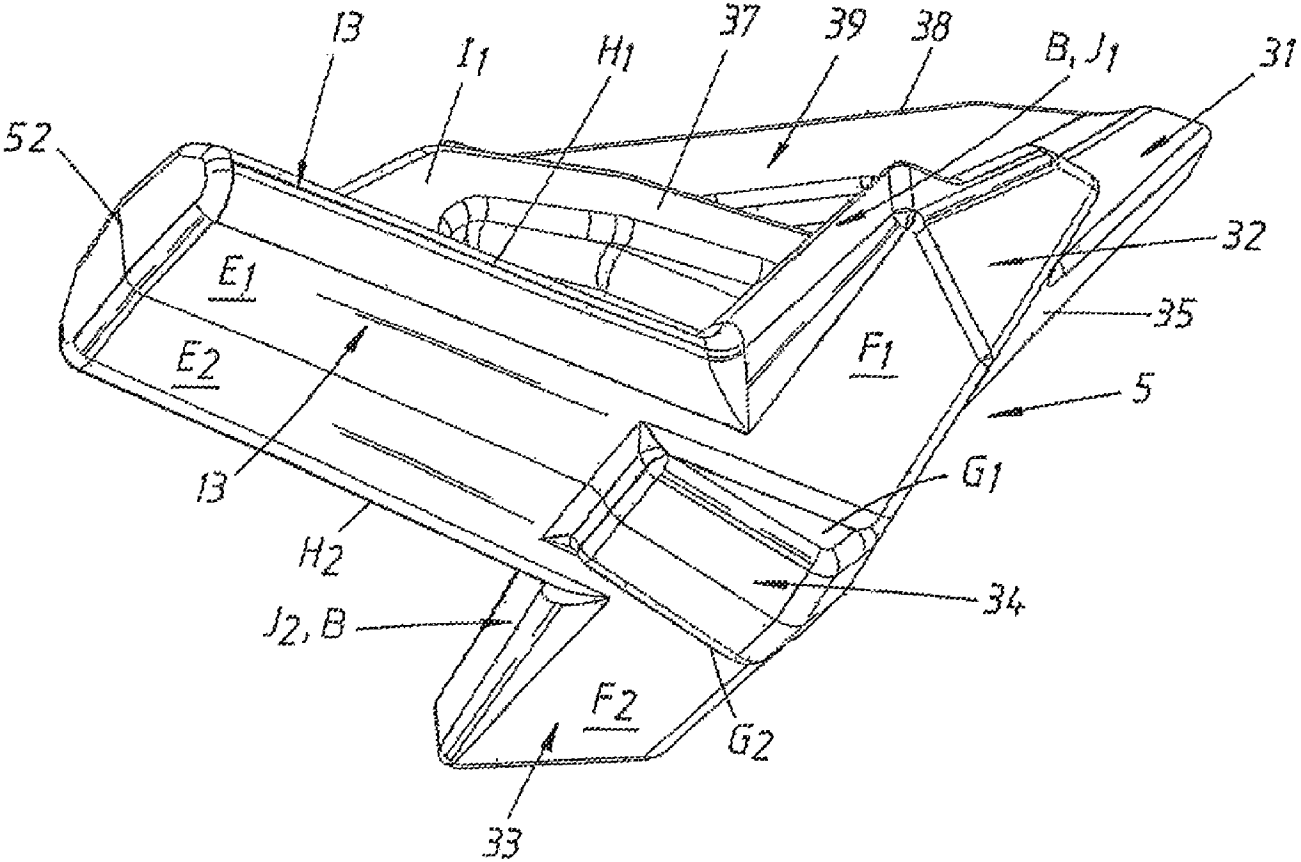
Figure 16:
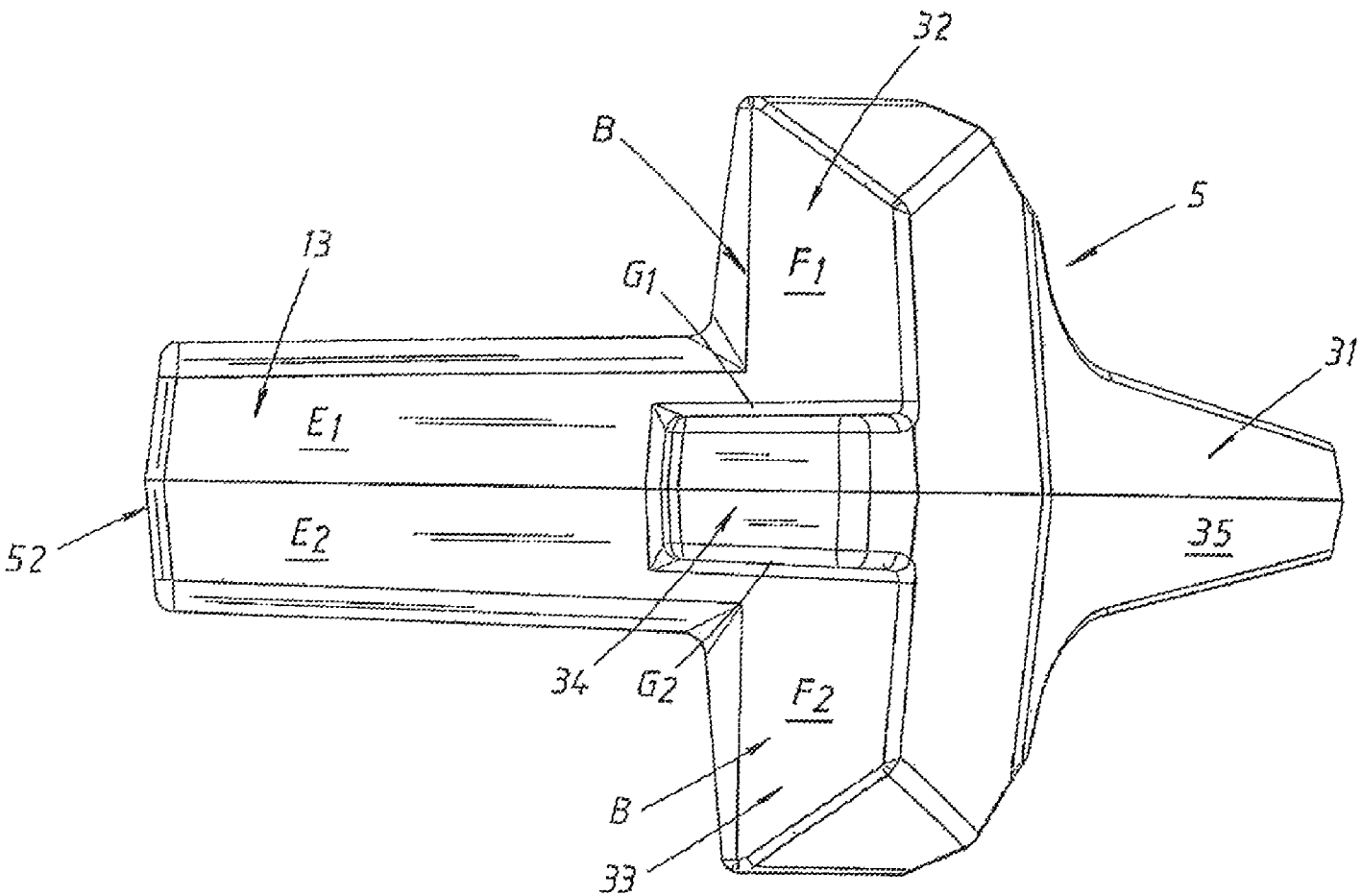
Figure 18:
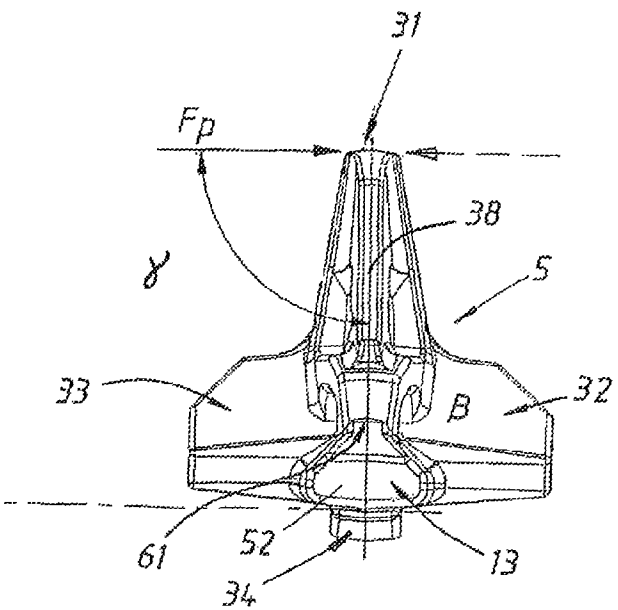
Figure 17:
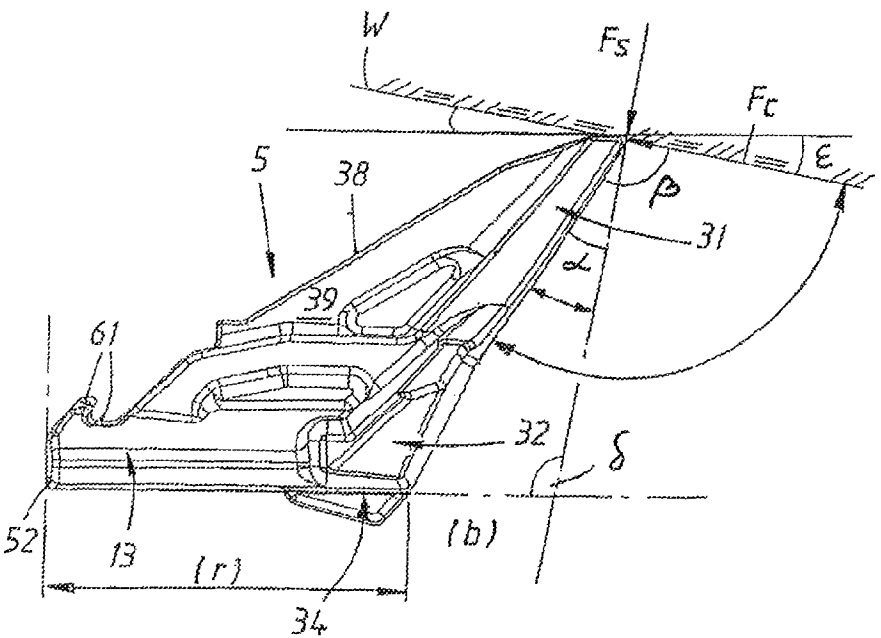
Figure 14:
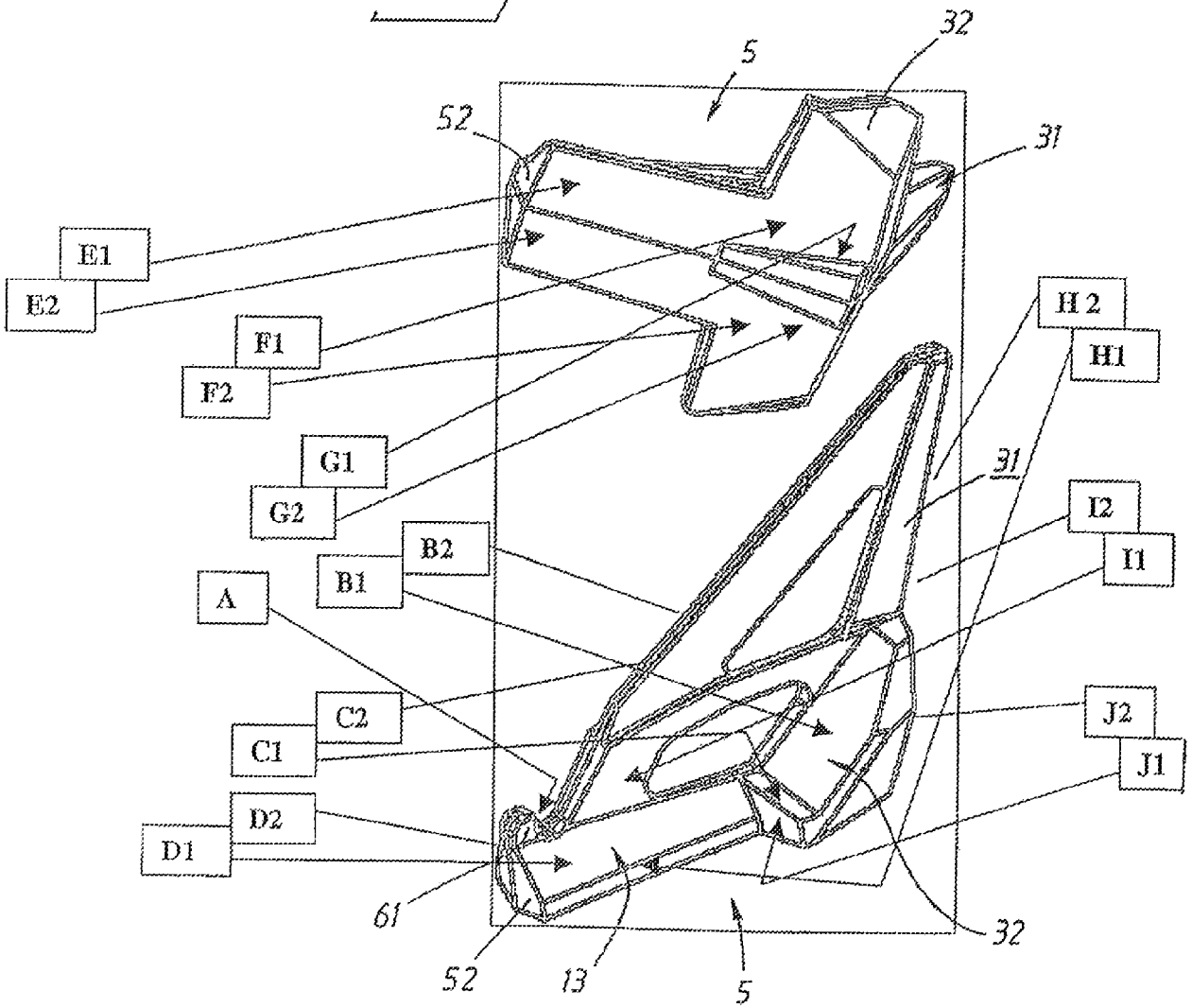
Figure 20:
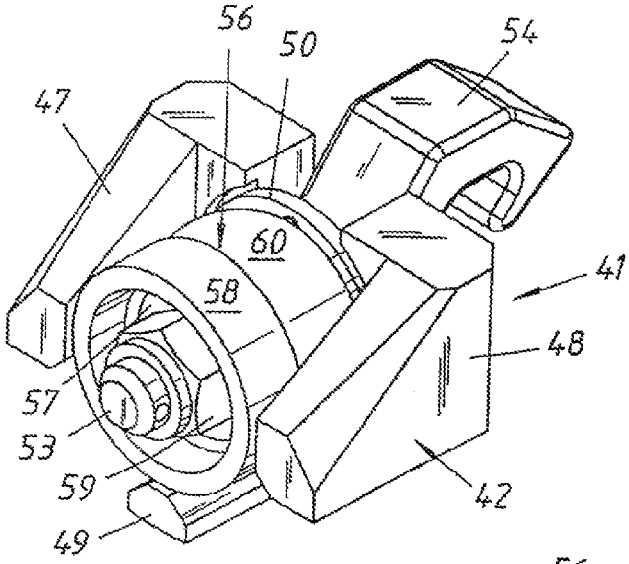
Figure 21:
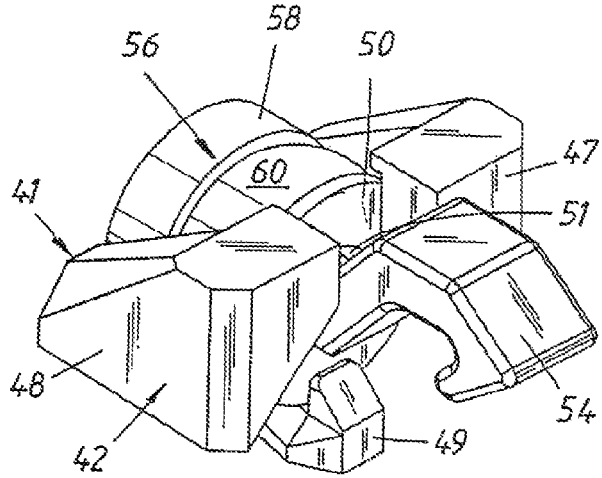
Figure 22:
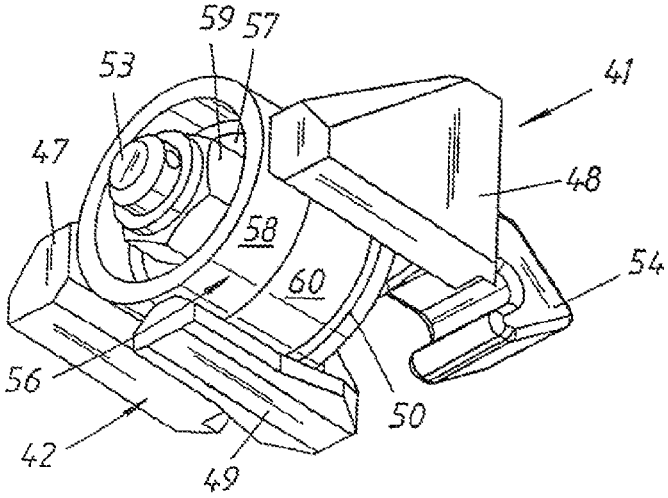
Figure 23:
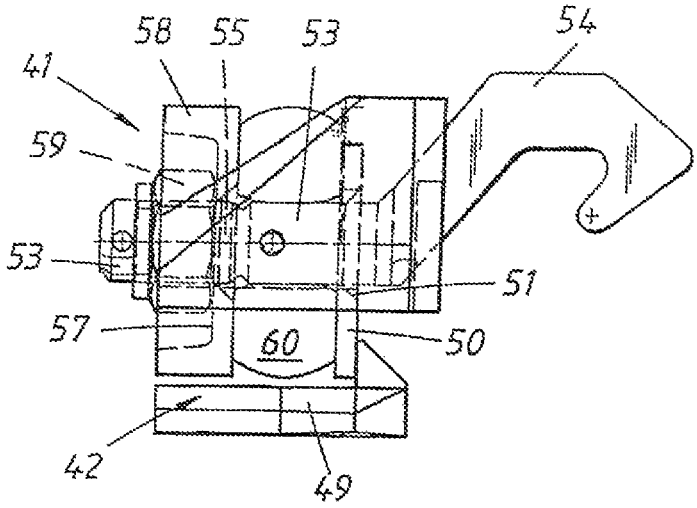
Figure 24:
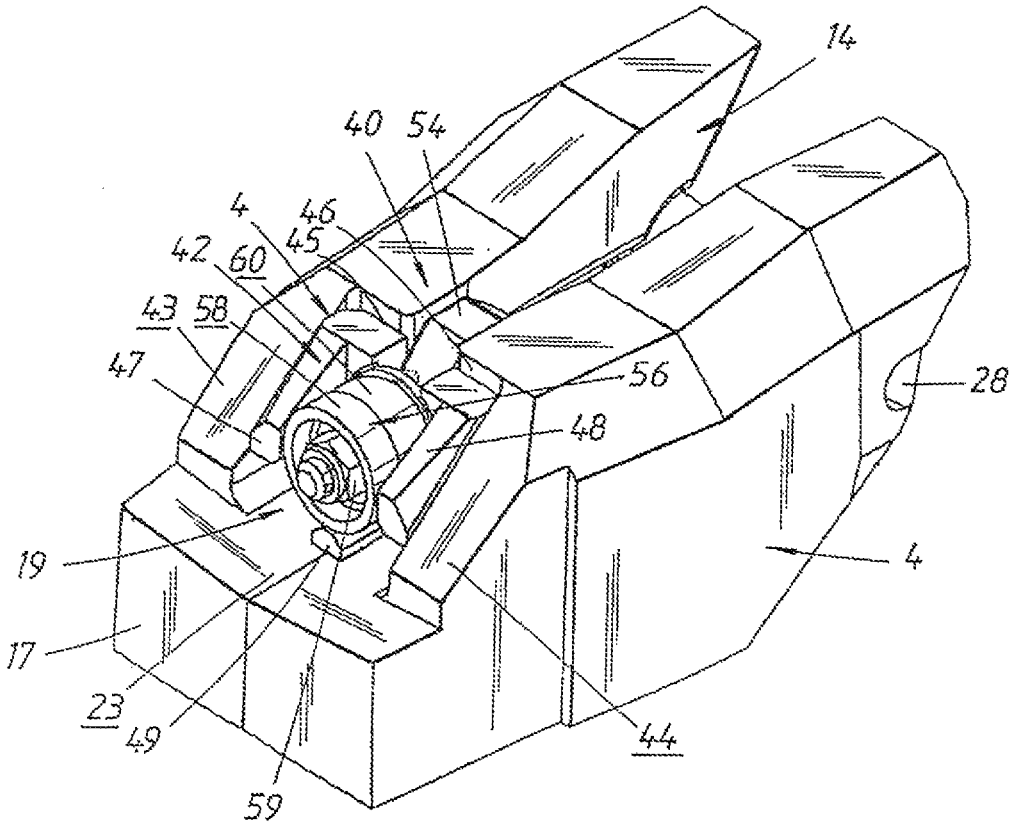
Figure 25:
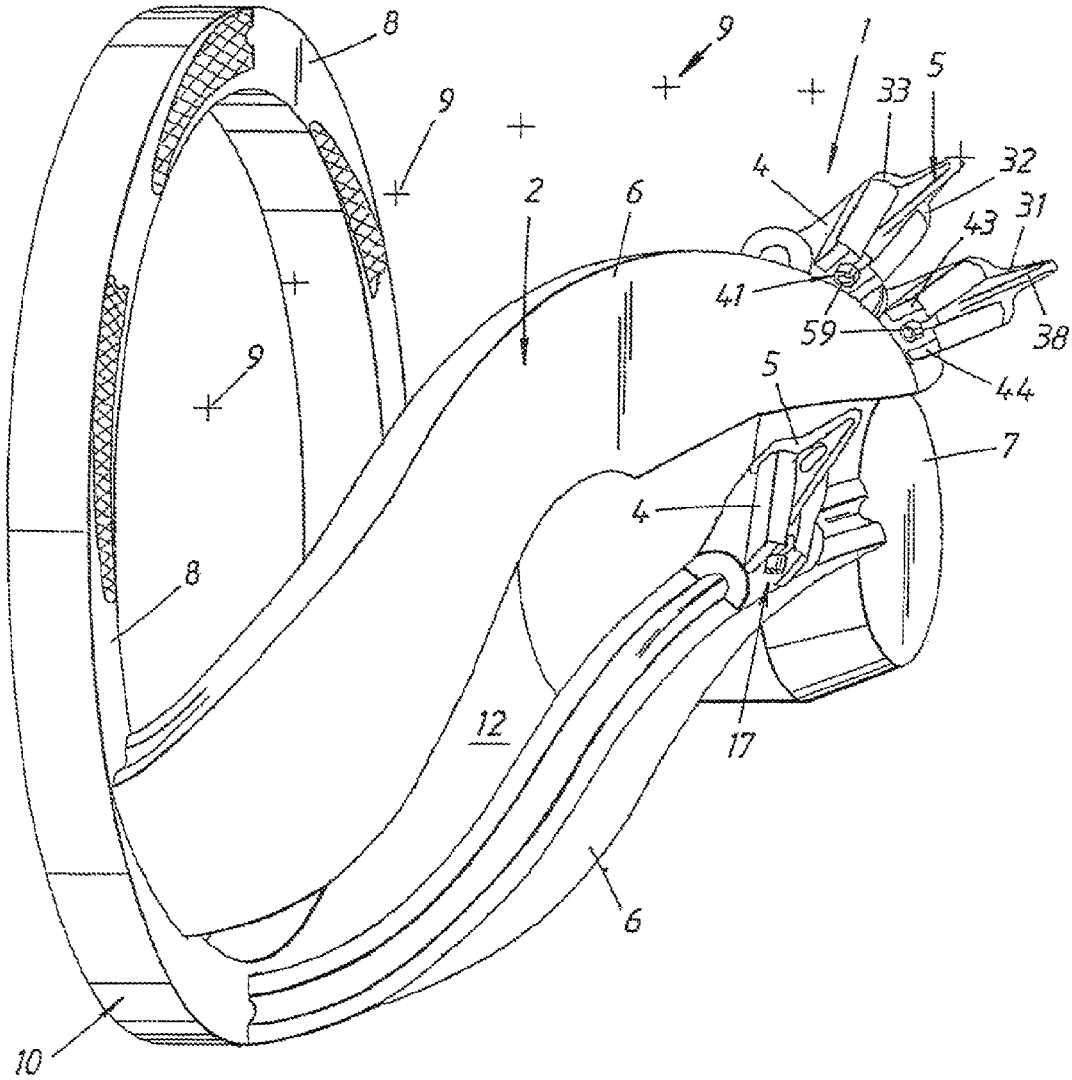

FIG. 3 is a schematic perspective seen angled from the rear of parts of a preferred embodiment of the tooth system in accordance with FIG. 1, which perspective shows the rear holder from which the front tooth portion is removably arranged along a common and interacting joint in the form of a notch, which in the given embodiment is formed by an upwardly open dovetail groove essentially axially arranged in the top side of the holder;

FIG. 4 is a schematic perspective of parts of the preferred embodiment of the holder in accordance with FIG. 3, showing a rear extension of the dovetail groove, intended for an unshown tensioning device for achieving internal pretensioning of the tooth portion, axially rearwards in the dovetail groove of the holder and a number of contact surfaces and clearance surfaces intended for transferring and positioning of loads arising between the tooth system's connection parts at selected places;

FIG. 5 is a schematic perspective of parts of the tooth portion, in accordance with FIG. 4, seen angled from the front showing frontal extensions of the cruciform dovetail groove, intended for the lateral wings of the of the tooth point, spine part and torque heel, see FIG. 10;

FIG. 6 is a schematic end view of parts of the holder in accordance with FIG. 4, seen from the rear;

FIG. 7 is a schematic end view of parts of the holder in accordance with FIG. 4, seen from the front;

FIG. 8 is a schematic side view of parts of the holder in accordance with FIG. 4, seen from the right side;

FIG. 9 is a schematic planar view of parts of the holder in accordance with FIG. 4, seen from above;

FIG. 10 is a schematic perspective, seen angled from the rear, of parts of a preferred embodiment of the tooth portion in accordance with FIG. 3, which view shows more closely the spine part of an angled upwardly arranged tooth point, that is, the spine of the wear part that is intended for application to a given working surface, a hook device interacting with the fastening device at the outer end of the tooth portion's rear, extended and male-formed leg, which is intended for insertion in the holder's essentially fitted dovetail groove, the right lateral wing of the tooth portion's two wings, the torque heel arranged thereunder and a number of contact surfaces and clearance surfaces;

FIG. 11 is a schematic planar view of parts of the tooth portion in accordance with FIG. 10, seen from above;

FIG. 12 is a schematic side view of parts of the tooth portion in accordance with FIG. 10, seen from the right side;

FIG. 13 is a schematic end view of parts of the tooth portion in accordance with FIG. 10, seen from the rear;

FIG. 14 is a schematic end view of parts of the tooth portion in accordance with FIG. 10, seen from the front;

FIG. 15 is a schematic perspective seen angled from beneath of parts of the tooth portion in accordance with FIG. 10;

FIG. 16 is a schematic bottom view seen straight from beneath of parts of the tooth portion in accordance with FIG. 10;

FIGS. 17 & 18 show, in relation to a side and an end view of the tooth portion in accordance with FIG. 10, an explanatory definition of the internally perpendicular component forces ($F_p$, $F_c$, $F_s$) resulting from the working forces;

FIG. 19 shows schematically the position for a number of contact and clearance surface(s) in relation to the tooth portion in accordance with FIG. 10;

FIG. 20-22 show a preferred embodiment of parts of the fastening device in accordance with the present invention in three schematic perspectives seen angled from above, angled from the front and angled from the beneath;

FIG. 23 shows a schematic cross section of parts of the fastening device in accordance with FIG. 20, seen from the right side and with certain parts deleted to better render visible the internal parts;

FIG. 24 is a schematic perspective seen angled from above of parts of the fastening device in accordance with FIG. 20 attached to the holder in accordance with FIG. 4;

FIG. 25 shows a schematic perspective seen angled from the side of parts of the rotation body of the dredger cutter in accordance with FIG. 2, in which view a number of teeth ate fastened to two of the blades between a central hub and back ring for holding the blades together; Some parts have been deleted to better render visible the internal parts of the rotation body.

Figure 26:
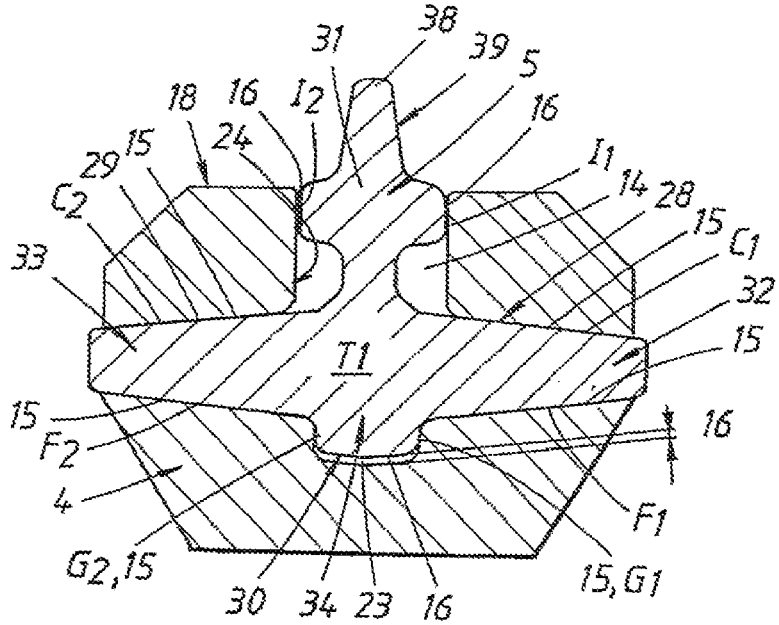
Figure 27:
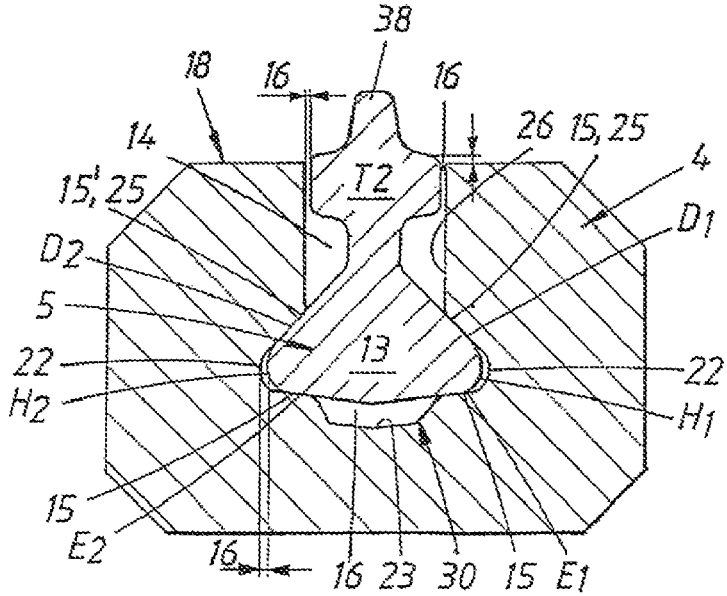

FIG. 26 shows a schematic cross section (T1) seen from the rear and situated within the front part of the joint through parts of the holder, notch and tooth portion's leg comprising the lateral wings and heel in accordance with FIG. 3;

and FIG. 27 shows a schematic cross section (T2) seen from the rear and situated within the rear part of the joint through parts of the holder, notch and tooth portion's leg nearer the back end and in accordance with FIG. 3.

DETAILED EMBODIMENT DESCRIPTION

With reference to FIGS. 1 and 2, there is schematically shown a tooth system 1 intended for a tool 2 for an earth moving machine 3 for the loosening and breaking of more or less hard earth and rock mass from a working surface (W), see FIG. 17, whereupon these masses can be removed in a suitable manner. The present invention 1 is of the type that comprises a holder 4 arranged at the tool 2 and a frontal tooth portion 5 in the form of a replaceable wear and/or replacement part intended for the earth moving itself, which tooth portion 5 is removeably arranged in relation to and at the holder 4. The tooth system 2, thus, comprises two main connection parts in the form of a "female part" 4 and a "male part" 5 that together form a unified and assembled "tooth". The holder 4 forms, preferably though not necessarily, the female part 4 of the present invention.

Examples of an earth moving machine 3, tool 2 and wear and/or replacement parts 5 suitable for a tooth system 1 in accordance with the invention are here embodied by the rotating bore bit 2 of a dredger cutter 3 with its replaceable wear teeth 5. In accordance with the present invention the tooth system 1 may of course also be used at other types of tools 2 of earth moving machines 3 as at the bucket of an excavator.

At the in FIGS. 1 and 2 especially shown dredger cutter 2, said wear teeth 5 are arranged in a predetermined distance from one another, along more or less helically extending blades 6, see FIG. 25. The blades 6 protrude from a rotational central hub 7 and backwards in the tool's 2 direction of feed to a uniting back ring 8 forming a rotation body 9. At the back end 10 of the rotation body 9 is a suction device 11, see FIG. 2, arranged for the removal of loosened earthen masses through an intermediary area or trough 12, see FIG. 25, between the helically shaped blades 6.

The tooth portion 5, see FIGS. 3, 5, 10 and 19, comprises a back leg 13 for assembly into a fitted cavity 14 at the holder 4 that is suitably fastened to the tool 2, e.g., with a weld joint or screw fastener. The cavity 14 is designed so that while interacting with the tooth portion 5 it receives the extended tooth leg 13, inclusive of those surfaces (B) of the tooth portion 5 that are facing theretoward and that, after assembly of the tooth portion 5 at the holder 4, during contact with the front (A) of the holder 4 is situated within an imagined vertical plane (XZ) situated directly in front of the forwardmost parts of the holder 4, see FIG. 5, and thereby achieve a common joint for the absorption of all loads $F_c$, $F_p$, $F_s$ arising through a predetermined connection geometry, essentially comprising the form of said leg 13 and cavity 14, comprising special opposed, internally and interacting contact surfaces 15 and, at least initially, clearance surfaces 16 arranged along the surfaces of the leg 6 and the cavity 14. By "at least initially" it is, here, meant that these clearance surfaces 16 can be reformed into contact surfaces after some degree of inevitable wear.

Two mutually opposed and interacting contact surfaces 15, arranged one on each connection part 4, 5, and arranged at a given angle to the axial symmetry axis Y of said joint, form a predetermined contact zone. At the front (A) of the holder 4, see FIG. 5, the contact surfaces 15 form a mainly blunt recess to said vertical plane (XZ), where the majority of the contact surfaces 15 at the forward part (C) of the joint, that is, comprising the front side (A) of the holder 4 and the back surfaces (B) of the tooth portion 5 that faces the holder 4, are arranged almost perpendicular to the longitudinal symmetry axis Y, that is, essentially in or parallel to the cross vertical plane (XZ). Thus, further insertion of the tooth portion 5 into the holder 4 is stopped in an abutted manner since the contact surfaces 15 at the front side (A) of the holder 4 together with the opposed contact surfaces 15 at the tooth portion 5, see FIG. 13, form stop surfaces in a mutual stop zone that makes up the forward part (C) of the joint between the connection parts, see FIGS. 3, 5, 11 and 26.

This forward part (C) generally absorbs all or at least the essential majority of all loads and torques that arise and as this stop zone (C) is considerably larger than those used by tooth systems known by prior art a powerful reduction of the load to surface ratio is achieved, which powerfully reduces wear, the risk of deformation, breakage and considerably extends the service life. The contact surfaces 15 along the back part (D) of the joint between the connection parts 4, 5, see FIGS. 3, 4, 11, and 27, are suitably arranged in a considerably more acute angle θ, depicted in the shown embodiment as being less than 10°, to the axial symmetry axis Y or parallel thereto, that is, essentially in the joining direction of the connection parts 4, 5 along the joint, which is why any possible remaining load here, although after long use, is still significantly lower than that at the front part (C) of the joint and absorbed by friction forces due to the wedging effect between these contact surfaces, that is friction surfaces 15', see FIGS. 4, 5 and 27.

The cavity 14, see FIGS. 4-7, 9 and 24, is designed, as depicted in the embodiment shown in said Figures, as an toward the interior of the holder 4, that is, a rearwardly, somewhat convergent notch 14. Said convergence, which is preferably identical for opposing surfaces after the initial joining of the connection parts 4, 5, make the connection parts 4, 5 "grip" harder together when pushed further inwards, though without the emergence of inner stop zones, since axial loads, also after a considerable amount of wear, are still absorbed by the forward part (C) of the joint where the contact surface area is considerable. The effect of transverse forces and torques on the design will be described in more detail below. Both the aforementioned problems with hammering and the problem with the tooth portion 5 becoming difficult to loosen from the holder 4 of a conventional tooth system, that is, tooth systems with one all too large play or an all too narrow fitting between the tooth portion 5 and the holder 4, obtain an optimal solution through the present invention. It is conceivable that the contact surfaces 15 at the back part (D) of the joint is wholly parallel with one another and with the axial symmetry axis Y, through which the advantage is obtained that the risk for connection parts 4, 5 shall grind against one another is wholly eliminated.

With reference to FIGS. 6, 7 and 9, a preferred embodiment of the notch 14 is shown seen from the back side 17 of the holder 4, from the front side (A) and from the top side 18. For an understanding, compare with FIGS. 11, 13 and 16, which show the tooth portion 5 seen from above, seen from the rear and seen straight upwards from beneath. With reference especially to FIG. 9, the notch 14 can be divided into a back 19, middle 20 and front 21 part(s). Within the back part 19 of the notch 14, see FIGS. 6 and 9, the lengthwise side walls 22 and the bottom 23 are essentially perpendicularly arranged, which is why the upward and rearward open cavity 14 becomes box-shaped, that is, the cross section within this part 19 is essentially U-shaped.

In the middle 20, lower part of the notch 14 the cross section (T2) is essentially designed as a rounded triangle where the blunt side 23' of the triangle is turned downward. The lengthwise, essentially vertical side walls 22, which are corresponded by the tooth portion's 5 sides, named H1 and H2, see FIG. 19, are, preferably, parallel or somewhat convergent while the bottom 23 is essentially perpendicular, that is, horizontally arranged theretoward. These lengthwise, essentially vertical side walls 22 shall preferably be clearance surfaces, see especially FIG. 27, while the upward continuation of the side walls 22 towards the upper, outer neck 24 of said notch 14 is formed by inwardly angled lengthwise sides 25 intended to form contact surfaces 15 together with the tooth leg 13 (see D1 and D2). The lengthwise side walls 26 of the notch neck 24 within the middle 20 and the front part 21 of the upper part of the notch 14, see FIGS. 7 and 9, extends symmetrically forward to the front side (A) of the holder 4 from an initial parallel portion 27.

Thus, in the middle part 20 of the dovetail groove 14, a lesser degree of play 16 is, at least initially, arranged on the one hand, between the vertical sides H1, H2 of the leg 13 and the accordant vertical sides 22 of the dovetail groove 14 at the bottom of the groove 23, that is, along the lower corners of the cross section (T2) and, on the other hand, the vertical sides 39 of the spine peak 38 and the dovetail groove's 14 accordant vertical sides 26 at its neck 24 and also between the lower side E1, E2 of the leg 13 and the dovetail groove's 14 accordant bottom 23; but the loads allowed at the location of the said play 16 are also considerably lower.

In the preferred embodiment, the cavity 14 is, thus, open rearwards at its back end 19, see FIG. 4, and also upwardly open 24 along its entire length, that is, the open notch 24 runs along the entire top side 18 of the holder 4, see FIG. 9. The aforementioned repairs and cleaning problems of existing tooth systems 1 of the leg-type are, thus, eliminated by the present invention. For other unshown embodiments, it is conceivable that said notch 14 is not open 24 along the entire top side 18, but rather the notch 14 is sealed a short segment on the back 19 top side 18 of the holder 4 (unshown).

Within the front part 21 of the notch 14 the cross section (T1), in the illustrated embodiment, is multi-armed, preferably cruciform, see FIGS. 7 and 26, comprising at least four grooves in the form of a notch dilations 24, 28, 29 and 30; the upper one of which is formed by the actual neck opening 14 of the notch and the other grooves 28, 29, 30 each comprise an enlargement of the cross section, which dilates from within the middle part 20 of the notch 14, relative to the axis Y, see FIGS. 5 and 7. The essentially frontally impacting winch forces ($F_s$), see FIG. 17, are absorbed, in the embodiment shown, by the stop surfaces formed by these wear extensions 28, 29, 30 along the impact zone (A, B) between connection parts 4, 5, essentially horizontally towards each side 28, 29 and vertically downwards 30.

A certain, though significantly lesser, part of the loads can, however, be transferred due to said convergence along the sides 23, 25 along the tooth system's joint between the back part 19 and middle part 20 of the notch 14 and the tooth leg's 13 contact surfaces 15, which axial load transference in that case also increases over the time of usage. Since the lengthwise sides 22, 23, 25, 26 of the joint have a high degree of resistance against friction forces the wear becomes negligible nevertheless.

The transverse forces $F_p$ and the shearing force $F_c$ and also the torques to which all the forces $F_p$, $F_s$, $F_c$ give rise are also absorbed by the contact surfaces 15 along the joint of the holder 4, but also these are for the most part absorbed at the front part (C) of the joint through the contact surfaces 15 along said wear extensions 28, 29, 30 whose relatively considerable contact surfaces guarantee a low surface load and, thus, minimal wear.

The notch 14 design shall be made more apparent by the description of the tooth portion's 5 leg 13 and those surfaces (B) of the tooth portion 5 that are facing toward the holder 4.

In the preferred embodiment of the tooth portion 5 shown in the Figures, the tooth leg 13 and the back surfaces (B) of the tooth portion 5 that are face toward the holder 4, see FIGS. 10, 13 and 26, a multi-armed, preferably cruciform cross section (T1) comprising at least four projection arms 31, 32, 33, 34 that each interact with its own groove 24, 28, 29, 30, respectively. The cross section may, though not shown in the embodiments, have more arms, e.g., the form of a five armed star or six armed asterisk, etc.

By contrast, fewer projections arms 31, 32, 33, 34 than four is not desirable because each of the three transverse loads should be absorbed by their own respective stop surfaces that are arranged transversely to each transverse load's direction of work, since the loads should be distributed over a large, total contact area, which area normally increases with the number of projection arms 31, 32, 33, 34 and since the projection arm 31 is, further, arranged out through the notch neck 24 and should have clearance and, thus, not initially contribute to load absorption. In the case of a rotary tool in which the rotational direction can be selected clockwise or counterclockwise, the importance of there being a stop surface for each direction of work clearly increases.

The lengthwise inner surfaces 22, 23, 26 along the back part 19 and middle part 20 of the notch 14 optimally should also not be load-affected or only absorb low loads and torques, that is, the greater part shall serve as clearance surfaces 16, see FIGS. 19 and 27. All or at least almost all loads and torques should instead be absorbed by a load transferring interaction between the wear extensions toward the sides 28, 29 and the downward 30 together with the corresponding projection arms 32, 33, 34.

In the embodiments shown, the projection arms 31, 32, 33, 34 are comprised by the back part 31 of the tooth portion 5 angled to a forward slope, essentially obliquely, and symmetrically upward, by the two laterally arranged wing portions 32, 33 that are essentially horizontal and symmetrical to either side of the tooth point 31 and an essentially downward vertically arranged heel 34. The arm 31 is also designated as the tooth point 31 when this "arm" 31 largely forms the portion outside the holder 4, see FIGS. 3, 17 and 18, while the other projection arms 32, 33, 34 to the greater extent if not wholly are situated within the holder's 4 grooves 28, 29, 30. The tooth point 31 in said embodiment has, in part, a front side 35 with an optimal angle $\alpha$ to winch force $F_s$ of 22° and an optimal angle $\beta$ of 112° to shearing force $F_c$, and in part an optimal angle $\gamma$ of 90° between the transverse force component $F_p$ and a vertical plane along the lengthwise symmetry axis Y. If the angular ratios of the impacting force components $F_p$, $F_c$, $F_s$ are instead shown in relation to a reference plane arranged along the symmetry axis Y, the angle $\delta$ between the reference plane and the winch force $F_s$ is optimally 100°, the angle $\epsilon$ between the reference plane and the shearing force $F_c$ is optimally 10°, while the transverse force component $F_p$, as before, impact parallel to the said reference plane, that is, with the optimal angle $\gamma$ of 90°. In conventional tooth systems the winch force angle $\alpha$ and shearing force angle $\beta$ are significantly greater, so that the lever principle is not exploited as fully as in the present tooth system design 1. The leverage ratio between the torque arms on either side of the fulcrum point that form the heel 34, e.g., the free, protruding length (b) of the tooth point 31 and the length (r) of the leg 13 that is inserted in the holder 4, is, here, significantly less than one, that is (b)/(r)<1, as seen against the conventional tooth system that is closer to two, that is, (b)/(r)=~2.

It shall be appreciated that the aforementioned angles and leverage ratio are not limited to exactly [exclusively] those values indicated, but rather they can vary within a reasonable interval.

With reference to FIGS. 17, 18 and 19, a further explanation of how the existing forces $F_5$, $F_c$, $F_p$ and the torques resulting from the forces $F_s$, $F_c$, $F_p$ around the heel 34, are intended to be absorbed, can be found below. The point forces $F_s$, $F_c$, $F_p$ are absorbed as surface loads through certain chosen contact zones comprising contact surfaces 15 along the notch 14, inclusive of notch dilations 28, 29 30 and to these opposed contact surfaces 15 along corresponding parts 32, 33, 34 of the tooth portion. The torques result in mutually interacting forces counter-directed on either side of the fulcrum point, which reaction forces are logically to be absorbed through at least two contact zones arranged one on either side of the given fulcrum point. For the purpose of simplicity, each contact zone is, here, summarized through the contact surfaces 15 of the tooth portion 4 in accordance with FIG. 19, however see other Figures also, especially FIGS. 26 and 27.

The winch force $F_s$ is absorbed essentially through the contact zones formed along the lower, essentially horizontal, lateral contact surfaces F1 and F2 on the two laterally arranged wing portions 32, 32 see FIGS. 5 and 15, and the upper, angled, lengthwise contact surfaces D1 and D2 on the upper part of the tooth leg 13, see FIGS. 6 and 10.

The shearing force $F_c$ is absorbed essentially through the contact zones formed along the upper, angled surfaces B1 and B2 on the tooth portion's 5 two laterally arranged wing portions 32, 32 see FIGS. 5 and 11, and the essentially horizontal, lower contact surfaces E1 and E2 on the bottom part of the tooth leg 13, see FIGS. 4 and 15.

The transverse forces $F_p$ and torques resultant therefrom, that are of course constituted by either pressure or tensile stresses depending on the changeable direction of impact of the particular force $F_p$, are absorbed for force from the right in FIG. 19, essentially through the contact zones formed along the essentially vertical, lengthwise surface G2 at the torque heel 34, see FIGS. 7 and 13, the upper, angled, lengthwise contact surface D1 at the top side of the tooth leg 13, see FIGS. 6 and 10, the lower, essentially horizontal, lateral contact surface F2 at the tooth portion's 5 one lateral wing portion 33, see FIGS. 5 and 15, the upper, angled surface B1 at the tooth portion's 5 other lateral wing portion 32, see FIGS. 5 and 11, and the upper, essentially horizontal, lateral contact surface C1 at the tooth portion's 5 lateral wing portion 32, see FIGS. 7 and 10.

For force $F_p$ affecting from the left, the contact surfaces G1, D2, F1, B2 and C2 apply in a corresponding manner.

It follows from this that the holder's 4 and tooth portion's 5 surfaces designated as H1, H2, I1, I2, J1, J2, in accordance with FIG. 19, are normally free of impact loads and, thus, clearing surfaces under normal conditions of usage for the tooth system 1. In the case of continued torques and deformation/wear, the clearance surfaces H1, H2, J1, J2, I1, I2 will slowly be transformed into contact surfaces, the surface loads will then be distributed over additional areas, thereby reducing the progression of wear. By the tooth system 1 also comprising an additional projection arm, that is the heel 34, in comparison with systems known by prior art, the considerable advantage is achieved where also the transverse forces $F_p$ are absorbed at the front part (C) of the joint, which is unique. By virtue of the connection geometry, in accordance with the present invention, the wear part 5 of each tooth 1 is held in place in a much more effective, secure and operationally reliable manner and that the impacting forces $F_s$, $F_c$, $F_p$ and their resultant torques, are normally only absorbed through the substantially larger contact surfaces 15 intended for this purpose as well as being intended for certain defined loads and torques, which contact surfaces for forces $F_s$, $F_c$, $F_p$ and for the torque dependent on $F_p$ are set mainly on the front part (C) of the joint, so that only a very minimal wear occurs, which considerably prolongs the life cycle of the tooth system 1.

After a period of use the impacting surface forces along the tooth system's 1 rear joint 13, 20 can possibly cause wear and a degree of plastic deformation of the effective parts 4, 5, which earlier required expensive and often complicated maintenance. Thanks to the possibility of clearance surfaces 16, these problems are eliminated or at least essentially reduced by a preferred embodiment of the present tooth system design 1 comprising a possibility to attach an easily removable insert, not shown, of a suitable hard metal at the rear contact surfaces 13, 20 of the joint, that is within the notch/dovetail groove 14, itself, which insert absorbs the impacting surfaces forces. A simple and uncomplicated maintenance is thereby achieved, when the insert can, quite simply, be replaced when it has worn out or been plastically deformed to a predetermined extent.

In the new, improved tooth system 1, further advantages are achieved by virtue of the fact that the upwardly open, extended notch 24, makes it possible to set another, secondary material reinforcement in the form of one or more strong, rigidity-enhancing devices 36 along the tooth portion's 5 spine part 37, which extends out of the notch 24 and holder 4, that is, above the spine part's 37 diagonal peak 38 and along its sides 39, through which it affords the possibility of increased strength of the tooth portion 5, which is, itself, wholly unique for tooth systems of the leg type 1. The spine part 37 protruding through and above the notch neck 24 also facilitates removal while a light tapping thereon releases the tooth portion 5.

In order to produce a dynamic, yet reliable fastening of the replaceable tooth portion 5 to the holder 4, the connection parts 4, 5 comprise, apart from the characteristic connection geometry of the aforementioned joint, also a locking system 40, common to parts 4, 5, for achieving an elastic, releasable and adjustable pretensioned locking, which locking system 40 will retain its ability to maintain a secure and cohesive locking of the connection parts 4, 5 throughout the lifecycle of the tooth system 1 without hammering, that is, due to its pretensioning ability, even while wear on the locking system 40 and/or connection parts increases.

The locking system 40 comprises, see FIGS. 20-24, a fastening device 41 arranged at the back side 17 of the holder 4, comprising a fitting device 42 designed to precisely fit into the cavity's 14 open rear, extended part 19 between two blades 43, 44, which suitably extend as a continuation, essentially in the axial direction, of the lengthwise side walls 22 of the notch 14 and toward two essentially vertical stop surfaces 45, 46 arranged transversely to the holder 4, one on either side of the notch 14. In the embodiment illustrated by FIGS. 20-24, the fitting device 42 comprises three L-shaped fitting pieces 47, 48, 49 attached at a central, circular front support plate 50 and through which supporting plate 50 a central hole 51 is made. Two of the fitting pieces 47, 48 are arranged to bear against the lengthwise walls 22 of the blades 43, 44 and the vertical stop surface 45, 46 of each, respectively, while the third fitting piece 49 is designed to bear against the bottom 23 of the notch and against the tooth leg's 13 transverse, rear end face 52, see FIG. 12. Further, the fastening device 41 comprises a bolt 53, see FIG. 23, which is arranged centrally through the fitting device 42 and support plate's hole 51. The bolt 53 has a claw or hook 54 arranged at the front end and a thread 55 on the rearward facing end intended for a rear tensioning and locking device 56.

A preferred embodiment of the tensioning and locking device 56 comprises a rear, with its internal bottom 57 sealed, sleeve 58 and a locking nut 59 that is rotatably arranged on said threaded bolt 53, inside said sleeve 58 and against said sealed bottom 57. Threaded on the bolt 53, between the sleeve's 58 sealed bottom 57 and the support plate 50, there is also an elastic body 60 arranged, through which a certain, determined pretensioning force can be transferred in an adjustable manner from the holder 4 to the tooth portion 5 through the tensioning device 41 in the form of a, under operation, dynamic, though always tensile, thus, always uniting axial force every time a new tooth portion 5 is installed even when the holder 4 is worn.

The placement of the tensioning device 41 at the rear end 17, 19 of the holder 4 in the present tooth system 1 protects the actual locking mechanism against damage from moved earthen masses, loosened by means of the tool 2, at the same time as the locking device 56 of the particular locking system 40 may be fitted and disassembled in a simpler and more efficient manner using some standard tool, expediently a pneumatic or electric-powered wrench, without causing a substantial hazard for damage.

The claw or hook 54 of the tensioning device 41 is arranged to grip in or around a recess or hook device 61 interacting with the tensioning device 41 and expediently arranged on the rear end 52 of the tooth portion 5.

Even if the space existing between the tooth portion 5 and the holder 4 and/or the space for adjacent teeth is cramped, it still afforded the improved locking system, according to the invention, access to the locking device 56 for service and easy replacement of a worn tooth portion 5.

In the shown embodiment of the tooth system 1 different types of locking systems and/or modifications of the locking system, itself, can be used, without essential adaptation of the tooth portion 5 and/or connection parts 4, 5 to the given locking system and/or its modifications. The locking system 40 also can not be affected by the problems of the holder's locking device opening no longer fitting the worn tooth portion's protruding locking device opening, which so often do affect conventional tooth systems as known by prior art. With the present locking system, the locking device 56 is installed, adjusted and removed axially at the rear end 17 of the tooth system 1 and this is done without possible deformations of the joint connection geometry complicating the work to be done.

The tensioning device 41 is, thus, configured in such a way that it provides adjustable, elastic pretensioning that tightness the holder 4 relative to the tooth portion 5, essentially internally along the notch and axially along the cavity's 14 axial symmetry axis Y, that is, essentially rearwards in relation to the tool's 2 direction of work and in which the multi-armed form and the pretensioning guarantee that the tooth portion 5 will always be situated in a predetermined position relative to the holder 4 and, thus, also in relation to the given tool 2 and also the working surface (W) throughout the tooth system's 1 entire life cycle.

Alternative Embodiments

The present invention is not limited to the embodiments, here, shown but can also vary in different ways within the framework of the patent claims.

It is to be appreciated that the number of arms, the size, the material and the form of the components of the tooth system and parts are adapted according to the prevailing conditions of the development opportunity.

We hereby claim and desire to secure by Letters Patent the following:

1. A tooth system intended for a tool of an earth moving machine, which tooth system is of the type comprising a holder attached to the tool and a front tooth portion, which is detachably arranged in relation to and on the holder and is in the form of an exchangeable wear part, replacement part, or both intended for the actual earth moving, which tooth portion comprises a rear leg and the holder comprises a cavity designed to receive the leg during interaction with the tooth portion and, thus, achieve a common joint for the absorption of arising forces through a predetermined connection geometry comprising special, opposed, mutually interacting contact surfaces and, at least initially, clearance surfaces that are arranged along the tooth portion and holder, wherein the tooth leg and cavity, along at least a front part of said joint have a multi-armed cross section comprising projection arms, and grooves each interacting with a projection arm and wherein a tensioning device is arranged at the cavity's rear part for achieving a tightening and adjustable pretensioning of the tooth portion in relation to the holder essentially axially along the cavity's longitudinal symmetry axis Y, wherein the projection arms comprise at least one essentially vertically arranged arm or heel and two, thereto-ward essentially lateral, wing portions, and wherein contact zones for transverse force absorption, as well as that of torques resultant therefrom, depending on a given force's direction of impact, are arranged along at least an essentially vertical, lengthwise contact surface at the torque heel, at least one upper, inclined, lengthwise contact surface at the top side of the tooth leg, at least one lower, essentially horizontal, lateral contact surface at one of the tooth portion's lateral wing portions, at least one upper, inclined contact surface at the tooth portion's other lateral wing portion and at least one upper, essentially horizontal, lateral contact surface at the tooth portion's other lateral wing portion; or, for a force from the opposite direction, essentially through the corresponding contact surfaces.

2. A tooth system in accordance with claim 1, wherein the projection arms comprise an, essentially vertically arranged, upper arm, a, essentially vertically arranged, lower heel and two, essentially horizontally lateral wing portions.

3. A tooth system in accordance with claim 1, wherein the tooth leg has a rearwards convergent cross section.

4. A tooth system in accordance with claim 3, wherein the cavity is designed as a notch inwardly convergent of the holder.

5. A tooth system in accordance with claim 1, wherein the cavity is open rearwards and upwards such that an open notch runs along the top side of the holder.

6. A tooth system in accordance with claim 1, wherein the cavity's rear part is comprised of lengthwise side walls and a bottom that is essentially perpendicularly arranged to each other with the cavity open upwards and to the rear, so that the cross section of this part is essentially U-shaped.

7. A tooth system in accordance with claim 1, wherein a cross section within a middle part of the cavity comprises a truncated, lower triangular part with essentially rounded corners, where the blunt, lower side forms the cavity's bottom and where the cross section's lower corners preferably comprise lengthwise clearance surfaces, while the cross section's upward continuation is primarily formed by inwardly angled lengthwise sides intended to form interacting contact zones together with the tooth leg's side surfaces and thereafter by lengthwise, essentially vertical, side walls at a certain distance from one another forming an upwardly open, upper notch neck.

8. A tooth system in accordance with claim 1, wherein the grooves within a front part of the cavity each comprise an outwardly dilating of the notch cross section from within the cavity and forward in relation to the axial symmetry axis Y.

9. A tooth system in accordance with claim 1, wherein a middle part of the cavity has a play arranged in part between the tooth leg's lower sides and the cavity's lengthwise sides at the cavity's bottom, and in part between the tooth portion's spine part's sides and the cavity's lengthwise upper sides and between the tooth leg underside and the cavity's bottom.

10. A tooth system in accordance with claim 1, wherein the tooth portion comprises a spine part protruding through the open notch.

11. A tooth system in accordance with claim 10, wherein a secondary material reinforcement is arranged at the tooth portion's spine part.

12. A tooth system in accordance with claim 1, wherein along a rear part of the joint between the connection parts are contact surfaces arranged in an acutely pointed angle δ that is less than 10° with respect to the lengthwise symmetry axis Y or parallel to the lengthwise symmetry axis Y.

13. A tooth system in accordance with claim 1, wherein the tooth portion or the holder comprises a protruding torque heel and that the opposed connection part comprises a corresponding depression, interacting with the heel to absorb the laterally impacting transverse forces, which impact perpendicular to the axial symmetry axis Y.

14. A tooth system in accordance with claim 1, wherein the projection arms are comprised by one, essentially somewhat forwardly inclined and upward symmetrically arranged, tooth point, and the two, essentially horizontal, lateral wing portions symmetrical on either side of the tooth point and an essentially downward vertically designed heel.

15. A tooth system in accordance with claim 1, wherein, after the assembly of the holder and the tooth portion, an impact zone at the beginning of the joint between them forms a common stop zone, whose stop surfaces comprise the front side of the holder and the opposed back side of the tooth portion, where the greater part of the tooth portion's surfaces that is in contact with the front side of the holder, are situated on the same side as the holder of an imagined vertical plane positioned directly in front of the forwardmost parts of the holder.

16. A tooth system in accordance with claim 1, wherein the essentially greater part of the loads and the torques resultant therefrom are absorbed through contact surfaces primarily at the forward part of the joint.

17. A tooth system in accordance with claim 1, wherein contact zones for winch force absorption, as well as the torques resultant therefrom, are arranged along lower contact surfaces at the tooth portion's two lateral wing portions and upper contact surfaces at the top side of the tooth leg.

18. A tooth system in accordance with claim 1, wherein contact zones for shearing force absorption, as well as that of torques resultant therefrom, are arranged along upper contact surfaces at the tooth portion's two lateral wing portions and lower contact surfaces at the lower side of the tooth leg.

19. A tooth system in accordance with claim 1, wherein the transverse and shearing and normal forces leverage ratio in relation to the axial symmetry axis Y and a fulcrum point around which the torsion occurs in the joint between the connection parts, where the tooth portion's protruding length along the axial symmetry axis Y from said fulcrum defines the first lever arm and where the length along the axial symmetry axis Y of the tooth leg inserted in the holder from said fulcrum defines the second level arm, is less than one.

20. A tooth system in accordance with claim 1, wherein the removably attachable fastening device at the back side of the holder comprises a fitting device, which is designed to fit the cavity's open rear part and against the tooth leg's end surface, a threaded bolt, which is arranged through the fitting device, with a forward claw or hook for interaction with a recess or a hook device arranged at the tooth portion, and a rear pretensioning and locking device comprising an elastic body and a locking mechanism for achieving a dynamic fixity and a reliable positioning at a predetermined position by the replaceable tooth portion at the holder through the multi-armed form and the adjustable pretensioning force.

21. A tooth system in accordance with claim 1, wherein the tooth system comprises a removable insert, suitably of hard metal, at the rear part of the joint within the cavity, which insert absorbs surface forces between the interacting connection parts.

22. A tooth system in accordance with claim 1, wherein the earth moving machine, the tool and the exchangeable wear part, replacement part, or both for the removal and breaking of masses from a working surface, are a dredger cutter's bore bit with its replaceable wear teeth.

23. A tooth system in accordance with claim 1, wherein the exchangeable wear part, replacement part, or both is a replaceable wear tooth.

24. A tooth system in accordance with claim 1, wherein the tool is a bore bit.

* * * * *